US008579255B2

(12) United States Patent
Ross

(10) Patent No.: US 8,579,255 B2
(45) Date of Patent: Nov. 12, 2013

(54) STEP RATCHET MECHANISM

(75) Inventor: Richard J. Ross, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 954 days.

(21) Appl. No.: 12/254,609

(22) Filed: Oct. 20, 2008

(65) Prior Publication Data

US 2009/0065217 A1 Mar. 12, 2009

Related U.S. Application Data

(63) Continuation of application No. 11/824,936, filed on Jul. 3, 2007, now Pat. No. 7,448,591.

(60) Provisional application No. 60/818,425, filed on Jul. 3, 2006.

(51) Int. Cl.
*F16K 31/44* (2006.01)

(52) U.S. Cl.
USPC ..... 251/230; 166/332.1

(58) Field of Classification Search
USPC ..... 251/62–63.6, 230, 343–344, 205–206; 166/332.1, 374, 323, 320–321
See application file for complete search history.

(56) References Cited

U.S. PATENT DOCUMENTS

| | | | | | |
|---|---|---|---|---|---|
| 2,815,925 | A | * | 12/1957 | Fisher, Jr. | 251/347 |
| 2,874,931 | A | * | 2/1959 | Baker et al. | 251/343 |
| 3,786,866 | A | * | 1/1974 | Tausch et al. | 166/322 |
| 3,850,250 | A | * | 11/1974 | Holden et al. | 166/374 |
| 3,882,935 | A | * | 5/1975 | Calhoun | 251/58 |
| 3,930,540 | A | * | 1/1976 | Holden et al. | 251/58 |
| 4,058,165 | A | * | 11/1977 | Holden et al. | 166/373 |
| 4,109,724 | A | * | 8/1978 | Barrington | 251/62 |
| 4,289,200 | A | * | 9/1981 | Fisher, Jr. | 166/120 |
| 4,474,242 | A | * | 10/1984 | Upchurch | 251/73 |
| 4,633,952 | A | * | 1/1987 | Ringgenberg | 166/336 |
| 4,711,305 | A | * | 12/1987 | Ringgenberg | 166/336 |
| 4,736,798 | A | * | 4/1988 | Zunkel | 166/321 |

(Continued)

FOREIGN PATENT DOCUMENTS

| | | |
|---|---|---|
| EP | 0068985 | 1/1983 |
| EP | 0435856 | 7/1991 |
| GB | 846859 | 8/1960 |
| GB | 2394735 | 5/2004 |

OTHER PUBLICATIONS

Description of BJ Services Body Lock Ring with Wedge Type Release and referenced figures, Dick Ross, p. 1-3.

(Continued)

*Primary Examiner* — John Bastianelli
(74) *Attorney, Agent, or Firm* — Parsons Behle & Latimer

(57) ABSTRACT

A step ratchet mechanism that allows for the incremental movement of an assembly that may be adapted to incrementally open or close an adjustable orifice. The step ratchet mechanism may be comprised of a modified body lock ring that permits incremental movement along a mandrel in either direction along the mandrel. The step ratchet mechanism may be actuated a designated distance by the application of pressure to the mechanism. The step ratchet mechanism may be ideal for using pressure to drive a downhole multi-position device. The modified body lock ring is adapted to both secure the mechanism at each set position as the mandrel is pumped down as well as allowing the mechanism to ratchet when the mandrel is pumped back.

12 Claims, 20 Drawing Sheets

(56) References Cited

U.S. PATENT DOCUMENTS

| | | | | |
|---|---|---|---|---|
| 4,862,957 | A | 9/1989 | Scranton | |
| 5,209,303 | A * | 5/1993 | Barrington | 166/374 |
| 5,704,393 | A * | 1/1998 | Connell et al. | 251/339 |
| 6,109,354 | A | 8/2000 | Riggenberg et al. | |
| 6,352,119 | B1 * | 3/2002 | Patel | 166/386 |
| 2004/0007356 | A1 * | 1/2004 | Myron | 166/240 |
| 2005/0077053 | A1 | 4/2005 | Walker et al. | |

OTHER PUBLICATIONS

Singapore Search and Examination Report mailed Jan. 18, 2010, for Application No. 2008093226-2.

* cited by examiner

STEP RATCHET MECHANISM

This application is a continuation application claiming priority to U.S. Non-Provisional application Ser. No. 11/824,936, entitled "STEP RATCHET MECHANISM" by Richard J. Ross, filed Jul. 3, 2007, which claims priority to U.S. Provisional Application Ser. No. 60/818,425, entitled "STEP RATCHET MECHANISM" also by Richard J. Ross, filed Jul. 3, 2006.

BACKGROUND OF THE INVENTION

1. Field of the Invention

The present invention relates generally to a step ratchet mechanism that may be ideal for driving a multi-position device, such as an adjustable orifice. The step ratchet mechanism allows for the multi-position device to be moved a predetermined incremental distance each time the step ratchet mechanism is cycled. The movement of an incremental distance may allow the incremental opening of an adjustable orifice to pressure test the seals before completely opening the orifice. The distance the multi-position device is driven per cycling of the step ratchet mechanism may be modified by the adapting the physical dimensions of the step ratchet mechanism components as would be recognized by one of ordinary skill in the art having the benefit of this disclosure. The step ratchet mechanism may include a body lock ring or a body lock collet that locks the mechanism to a mandrel as the step ratchet mechanism moves during each cycle. The body lock ring or body lock collet may be adapted to also allow movement of the step ratchet mechanism in the opposite direction along the mandrel.

2. Description of Related Art

The use of a body lock ring is a well known to lock a downhole assembly to a mandrel. Current body lock rings generally allow the assembly to travel along a mandrel in one direction, locking the assembly down to the mandrel each time the assembly stops moving. Body lock rings generally allow the assembly to be ratcheted along the mandrel in one direction, but typically are designed to lock the assembly to the mandrel and thus, do not allow the assembly to travel or ratchet in the other direction along the mandrel. This function of the body lock ring is often acceptable as the purpose of the body lock ring is to secure the downhole assembly to the mandrel. The current designs utilizing body lock rings do not allow the assembly to move along the mandrel in the opposition direction if so desired. If the downhole assembly needs to be removed from the mandrel, the downhole assembly and body lock ring may have to be drilled out of the wellbore.

The one-direction ratcheting nature of the body lock ring has limited its use to applications that only require movement in one direction. It would be beneficial to provide a device that ratchets or moves incrementally in one direction securing a downhole assembly to a mandrel, but that also allows the downhole assembly to move along the mandrel in the opposite direction when so desired. For example, such a device may be useful in conjunction with a flow orifice. Downhole orifices are often used to regulate the amount of flow from a particular zone as excessive flow rates can cause formation damage or produce sand. Current body lock rings may be applicable to be used in such an instance. However, it would also be desirable to close the flow orifice if need be, which is not possible with current body lock ring designs. A device that allows incremental movement to open a flow orifice locking the flow orifice in place between incremental movements, but also while allowing movement in the opposite direction to also close the flow orifice would be beneficial.

In light of the foregoing, it would be desirable to provide a mechanism that provides for incremental movement in a first direction along a mandrel, secures an assembly to the mandrel, and also allows for movement of the mechanism in a second direction along the mandrel. It would be further desirable to provide a body lock ring that is adapted to both lock an assembly against a mandrel and also allow the body lock ring to release from the mandrel allowing the body lock ring and any connected assembly to travel along the mandrel. It would also be desirable to provide a mechanism that may be used to incrementally drive a multi-position device, such as an adjustable orifice, in one direction that also allows the movement of the multi-position device in the opposite direction while preventing movement of the orifice.

The present invention is directed to overcoming, or at least reducing the effects of, one or more of the issues set forth above.

SUMMARY OF THE INVENTION

The present invention provides embodiments and methods for a step ratchet mechanism that allows for the incremental movement of an assembly that may be adapted to incrementally open or close an adjustable orifice. The step ratchet mechanism may be comprised of a modified body lock ring that permits incremental movement along a mandrel in either direction along the mandrel. The step ratchet mechanism may be actuated a designated distance by the application of pressure to the mechanism. The step ratchet mechanism may be ideal for using pressure to drive a downhole multi-position device. The modified body lock ring is adapted to both secure the mechanism at each set position as the mandrel is pumped down as well as allowing the mechanism to ratchet when the mandrel is pumped back.

In an exemplary embodiment, the step ratchet assembly comprises a mandrel, a top connector, a locking mechanism, a locking mechanism carrier, and a driving mechanism adapted to drive the locking mechanism and the mandrel, wherein the step ratchet assembly is adapted to move the mandrel in a first direction and a second direction opposite the first direction.

An exemplary method of the present invention may provide a method for movement along a mandrel, the method comprising the steps of: providing a downhole assembly surrounding the mandrel, the downhole assembly having a step ratchet assembly attached thereto, the step ratchet assembly comprising: a locking mechanism having an inner and outer surface, the inner surface of the locking mechanism adapted to selectively engage the mandrel; and a locking mechanism carrier having an inner and outer surface, the inner surface of the locking mechanism carrier adapted to selectively engage the locking mechanism; driving the mandrel in a first direction; and driving the mandrel in a second direction opposite the first direction. In another exemplary embodiment, the driving steps are accomplished by applying fluid pressure to a driving mechanism.

Figure 1:
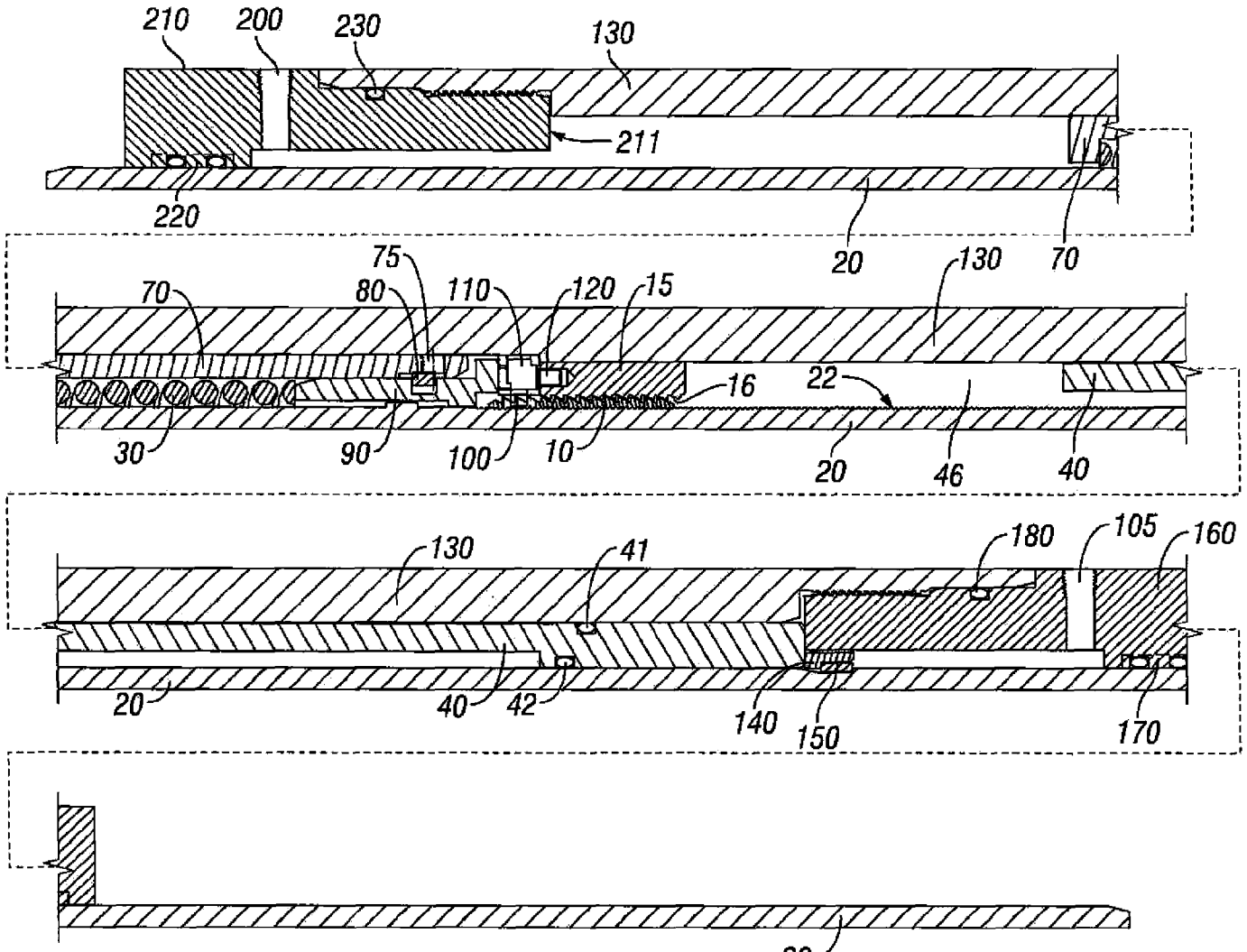
FIG. 1 is cross-section view of one embodiment of a step ratchet mechanism that includes a body lock ring 10.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the use of a step ratchet mechanism adapted to incrementally drive a downhole assembly. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows one embodiment of the step ratchet mechanism that uses a body lock ring 10 that engages a body lock ring carrier 15 and selectively engages a mandrel 20. The body lock ring 10 includes inner teeth 12 (shown in FIG. 5) that selectively engage the teeth 22 located on the outside of the mandrel 20 and the body lock ring 10 includes outer teeth 11 (shown in FIG. 5) that engage the teeth 16 on the interior of the body lock ring carrier 15. The inner teeth 12 of the body lock ring 10 are adapted to allow the body lock ring 10 to ratchet in one direction along the mandrel 20 and also move along the mandrel 20 in the opposite direction when a back pressure is applied to the mechanism as described below.

The step ratchet mechanism includes a piston 40 positioned in a chamber 46 located between the mandrel 20 and a top connector 130. At one end of the chamber 46, is an upper adapter 160 and at the other end of the chamber 46 is a lower adapter 210. The piston 40 is movable within the chamber 46 and includes an upper sealing element 41, such as an o-ring, to seal with the top connector 130. The piston 40 also includes a lower sealing element 42, such as an o-ring, that seals the orifice between the piston 40 and the mandrel 20. In the initial state of the step ratchet mechanism, the upper portion of the piston 40 is located adjacent to the lower portion the upper adapter 160.

The upper adapter 160 interfaces with the top connector 130 and the mandrel 20. The upper adapter 160 may include an upper sealing element 180, such as an o-ring, to seal the interface with the top connector 130 and a lower sealing element 170, such as a standard chevron, that seals the interface with the mandrel 20. The upper adapter 160 includes an upper port 105, which allows for pressure to be applied to the system. The lower adapter 210 is located at the other end of the top connector 130 and includes a sealing element 230, such as an o-ring, located between the connection interface. The lower adapter 210 includes a fluid port 200 and interfaces with the mandrel 20, which may include a sealing element 220, such as a standard chevron, between the interface. The embodiment may include a lock ring holder 140 and a ratchet lock ring 150 both positioned between the mandrel 20 and the upper adapter 160. The ratchet lock ring 150 may be a split snap ring that snaps into a groove (not shown) on the mandrel 20. The long ring holder 140 is a snap ring retainer that helps secure the ratchet lock ring 150 to the mandrel. The ratchet lock ring 150 provides an upset for the piston 40 to contact to move the mandrel 20 back to its original position as detailed below.

The application of pressure through the upper port 105 causes the piston 40 to move along the chamber 46 between the top connector 130 and the mandrel 20 moving away from the upper adapter 160. The piston 40 will contact the upper portion of body lock ring carrier 15 pushing the assembly of the body lock ring carrier 15 and the body lock ring 10 in the same direction as the piston. As pressure is applied to the system, the body lock ring 10 is pushed against the mandrel 20 such that the teeth 12 engage (shown in FIGS. 5 and 6) the teeth 22 located on the exterior of the mandrel 20. Thus, the movement of the body lock ring 10 away from the upper adapter 160 also moves the mandrel 20 away from the upper adapter 160.

The initial application of pressure causes the movement of the body lock ring holder 110 until it is positioned adjacent to a spring lock 90. The spring lock 90 is positioned adjacent to a spring 30 located within a spring holder 70. Snap ring 80 holds spring holder 70 and spring lock 90 together and maintains a pre-load on spring 30. Hole 75 provides access to snap ring 80 for assembly purposes. The movement of the piston 40 causes the movement of the body lock ring assembly and the spring lock 90 to move away from the upper adapter 160 until the lower portion of the spring holder 70 contacts the shoulder 211 of the lower adapter 210.

Once the spring lock 90 contacts the shoulder 211 of the lower adapter 210, the spring 30 pushes against further movement of the body lock ring assembly and the mandrel 20 away from the upper adapter 160. As the pressure is increased, the body lock ring assembly pushes against the spring lock 90 compressing the spring 30. The pressure is increased until the spring lock 90 and the body lock assembly cause the spring 30 to become completely compressed within the spring holder 70. As discussed above, the movement of the body lock ring assembly also causes the movement of the mandrel 20 away from the upper adapter 160 because the interior teeth 12 of the body lock ring 10 are engaged with the exterior teeth 22 of the mandrel 20. During the initial cycle the mandrel 20 moves an initial distance until the spring holder 70 contacts the shoulder 211 of the lower adapter 210 plus the mandrel 20 moves an incremental distance that the body lock ring assembly travels while compressing the spring 30 within the spring holder 70. In one embodiment, the mandrel 20 may travel between 5 and 6 inches due during the initial pressure cycle. The length of the chamber and dimensions of the spring holder 70, and lock ring assembly may be adapted to modify the initial movement of the mandrel 20 as would be appreciated by one of ordinary skill in the art having the benefit of this disclosure. In subsequent cycles, the mandrel 20 only travels the incremental distance required to compress the spring 30 within the spring holder 70. In some embodiments, this incremental distance may be ¼ inch, however this distance may also be modified by varying the dimensions of the spring 30 and spring holder 70 as well as the strength of the spring 30.

After the spring 30 has been completely compressed, the pressure may then be bled off the system allowing the spring 30 to return to its uncompressed state pushing the spring lock 90 and the body lock ring assembly away in the opposite direction. Friction holds the mandrel 20 in place as the body lock ring assembly moves in the opposite direction. In some embodiments, a separate mechanism may be employed to hold the mandrel in position as the body lock ring assembly and spring lock 90 moves away from the compressed spring 30. The interior teeth 12 of the body lock ring 10 are adapted to allow movement along the mandrel 20 in the opposite direction as discussed in more detail below in regards to FIGS. 5 and 6. As will be recognized by one of ordinary skill in the art having the benefit of this disclosure, the spring constant of the spring 30 must be greater than the force required to allow the mechanism to ratchet along the mandrel 20. Additionally, the body lock assembly must be sufficiently strong to withstand the amount of pressure required to overcome the spring constant in order to ratchet the mechanism and move the mandrel 20 away from the upper adapter 160. The application of pressure to the system allows the mechanism to again move the body lock ring assembly and the mandrel 20 down an incremental distance until the spring 30 has been fully compressed within the spring holder 70. As discussed above, the dimensions of the spring 30 provides for the incremental distance moved by the mandrel 20 during each subsequent pressure cycle. After the initial cycle, the travel of the mandrel 20 and body lock ring assembly are limited to the distance required to completely compress the spring 30.

The pressure can be repeatedly cycled to incrementally move the mandrel 20 down the assembly until the mandrel has reached a final position. The mandrel 20 may include a stop 21 (Shown in FIGS. 7-11) that contacts the piston 40 when the mandrel 20 has been moved the designated distance. The stop 21 prevents further cycling of the step ratchet mechanism.

Back pressure may be applied to the system causing the piston 40 to move away from the lower adapter 210 and return to its initial position. The piston 40 may engage the ratchet lock ring 150 pulling the mandrel 20 back to its initial position. Alternatively, the mandrel 20 could include an upset that the piston 40 could engage pulling the mandrel back to its position as would be appreciated by one of ordinary skill in the art having the benefit of this disclosure. Likewise, the mandrel 20 may engage the body lock ring assembly pulling the assembly away from the lower adapter 210 and back to its original position. Alternatively, the application of back pressure may be used to move the body lock ring assembly and the spring holder 70 away from the lower adapter 210 to their original positions. A body lock ring holder 110 is used to anchor the body lock ring 10 to the top connector 130 when the mandrel 20 is moved back to its original position. The body lock ring holder 110 includes a vertical pin 120 positioned within the body lock ring carrier 15. The body lock ring holder 110 also includes axial pins 100 positioned through openings 13 (shown in FIG. 5) in the body lock ring 10. The axial pins 100 prevent the rotation of the body lock ring carrier 15 relative to the body lock ring 10.

Figure 2:
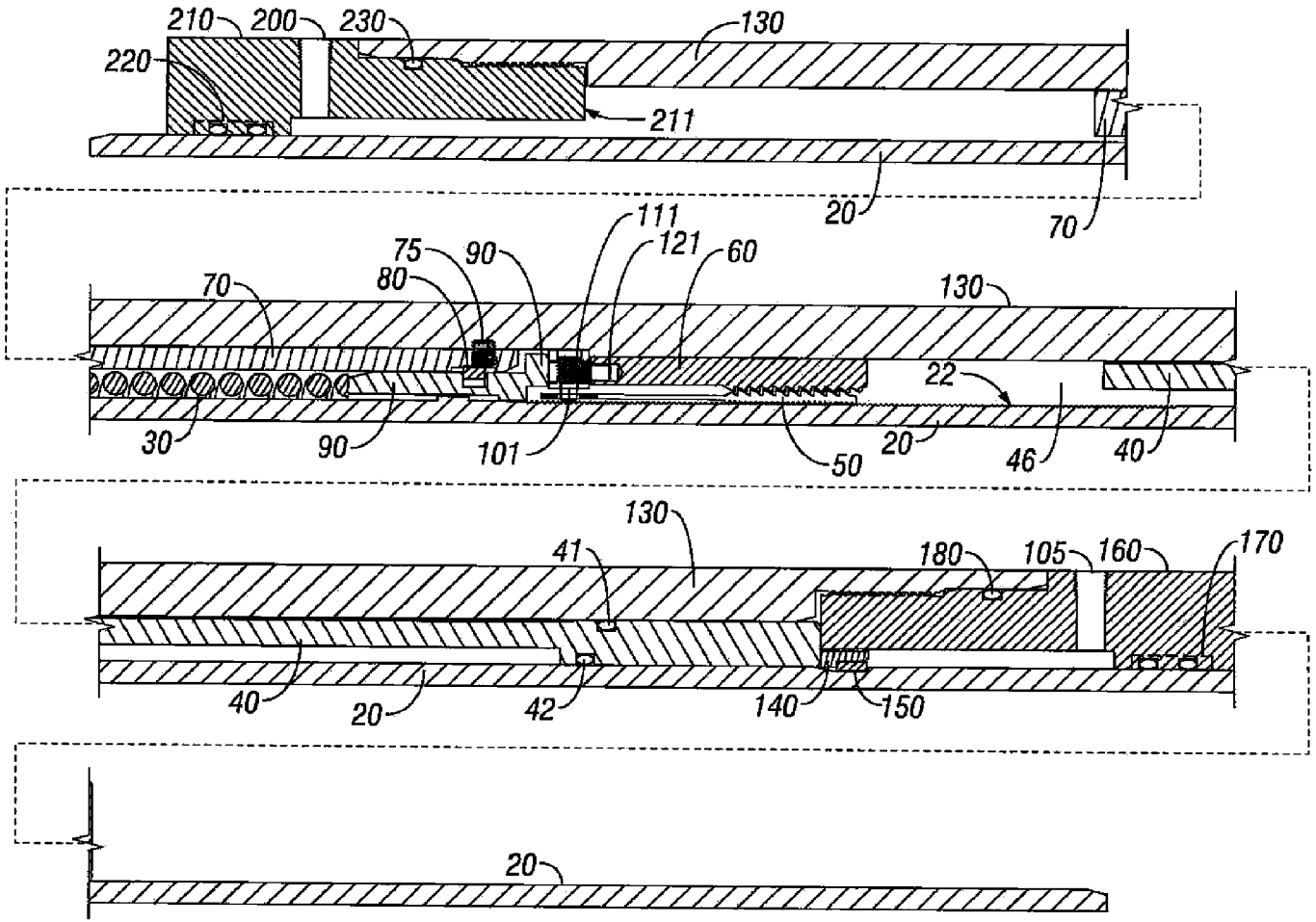
FIG. 2 is a cross-section view of one embodiment of a step ratchet mechanism that includes a body lock collet 50.

FIG. 2 shows an embodiment of the present disclosure that uses a body lock collet 50 and collet carrier 60 in place of the body lock ring 10 and body lock ring carrier 15 of the embodiment of FIG. 1. The mechanism operates in the same manner as the embodiment of FIG. 1. Pressure is applied to the system and the piston 40 pushes the body collet assembly down the top connector 130 away from the upper adapter 160. The pressure causes the interior teeth 52 of the body lock collet 50 to engage the teeth 22 on the exterior of the mandrel 20 thus, also moving it along the top connector 130 away from the upper adapter 160. When the spring holder 70 contacts the lower adapter 210 the pressure is increased until the collet assembly and the spring lock 90 completely compress the spring 30 located within the spring holder 170. The length of the collet fingers 54 allows for greater variation in the spring constant of the spring 30 used in the step ratchet mechanism.

Back pressure may also be applied to the system of FIG. 2 by applying pressure through the fluid port 200 in the lower adapter 210 causing the piston 40 to move away from the lower adapter 210 and return to its initial position. The piston 40 may engage the ratchet lock ring 150 on the mandrel 20 pulling the mandrel 20 back to its initial position. Alternatively, the mandrel 20 could include an upset that the piston 40 could engage pulling the mandrel back to its position as would be appreciated by one of ordinary skill in the art having the benefit of this disclosure. Likewise, the mandrel 20 may engage the body lock collet assembly pulling the assembly away from the lower adapter 210 and back to its original position. Alternatively, the application of back pressure may be used to move the body lock collet assembly and the spring holder 70 away from the lower adapter 210 to their original positions. A body lock collet holder 111 is used to anchor the body lock collet 50 to the top connector 130 when the mandrel 20 is moved back to its original position. The body lock collet holder 111 includes a vertical pin 121 positioned within the body lock collet carrier 60. The body lock collet holder 111 also includes axial pins 101 positioned through openings 53 (shown in FIG. 3) in the body lock collet 50. The axial pins 101 prevent the rotation of the body lock collet carrier 60 relative to the body lock collet 50.

Figure 4:
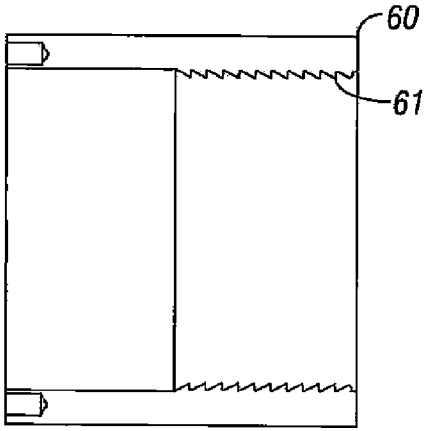
FIG. 4 is a side cross-section view of a collet carrier 60 used in conjunction with the body lock collet 50 of FIG. 3.
Figure 3:
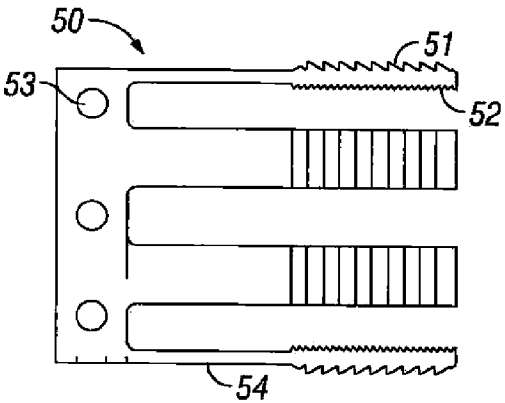
FIG. 3 is a side view of a body lock collet 50 used in one embodiment of a step ratchet mechanism.

FIG. 3 is an isometric view of a body lock collet 50 of one embodiment of the present disclosure. The body lock collet 50 includes collet finger 54 located around the perimeter of the collet. The number and width of the collet fingers 54 may be varied depending on application using a step ratchet mechanism as would be appreciated by one of ordinary skill in the art having the benefit of this disclosure. The interior surface of each collet finger 54 includes teeth 52 that are adapted to selectively engage the outer teeth 22 of the mandrel 20. The exterior surface of the each collet finger 54 includes teeth 51 adapted to engage with the interior teeth 61 of the body lock collet carrier 60. FIG. 4 shows one embodiment of a body lock collet carrier 60 of the present disclosure. The body lock collet carrier 60 includes teeth 61 on the interior surface, the teeth 61 being adapted to engage with the teeth 51 located on the collet fingers 54. The body lock collet 50 may include openings 53 located around the perimeter to aid in the connecting the body lock collet 50 to the body lock collet holder 110. For example, pins 101 may protrude from the body lock collet holder 110 through the openings 53 in the body lock collet 50.

Figure 5:
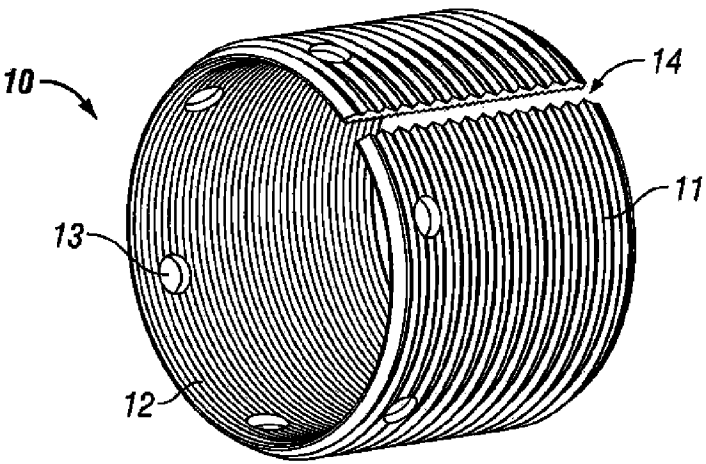
FIG. 5 is an isometric view of a body lock ring 10 used in one embodiment of a step ratchet mechanism.

FIG. 5 is an isometric view of a body lock ring 10 of one embodiment of the present disclosure. The interior surface of the body lock ring 10 includes teeth 12 that are adapted to selectively engage the outer teeth 22 of the mandrel 20. The body lock ring 10 may include a gap 14 in the body. The gap 14 may aid in the selective engagement of teeth 12 with the teeth 22 of the mandrel 20. The exterior surface of the body lock ring 10 includes teeth 11 adapted to engage with the interior teeth of the body lock ring carrier 15. The body lock ring 10 may include openings 13 located around the perimeter to aid in the connecting the body lock ring 10 to the body lock ring holder 110. For example, pins 100 may protrude from the body lock ring holder 110 through the openings 13 in the body lock ring 10.

Figure 6:
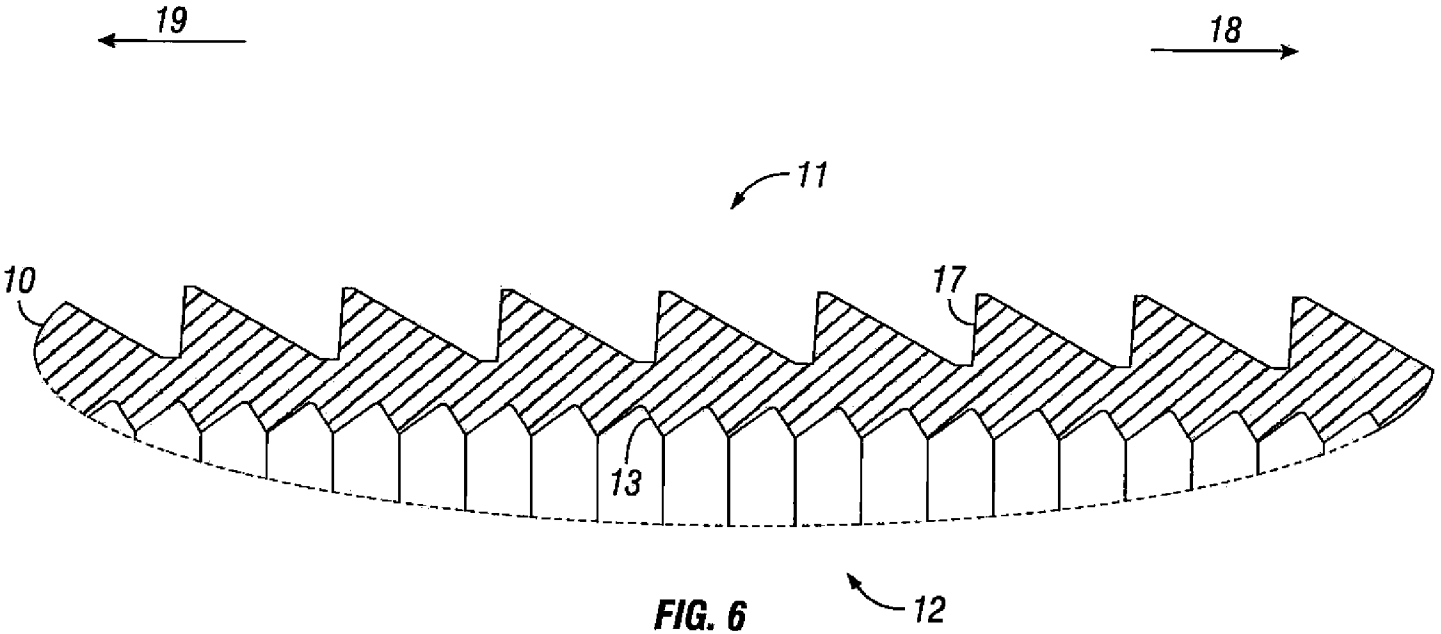
FIG. 6 is a cross-section view of one embodiment of the engaging teeth of the body lock ring 10 with outer teeth 11 that engage the body lock ring carrier 15 and inner teeth 12 that engage the mandrel 20.

FIG. 6 is a cross-sectional view of the teeth of the body lock ring 10. The exterior surface of the body lock ring 10 includes teeth 11 that are configured to engage with the interior teeth of the body lock ring carrier 15. The interior surface of the body lock ring 10 includes teeth 12 that are adapted to selectively engage the teeth 22 located on the exterior surface of the mandrel 20. A 90 degree face 17 on the outer teeth 11 in combination with an angle substantially less than 90 degrees on the inner teeth allows the body lock ring carrier 15 to ratchet the body lock ring 10 along the mandrel 20 in a direction 18 away from the lower adapter (not shown in FIG. 6). An angle substantially less than 90 degrees on the outer teeth, in combination with an angle of 90 degrees on the inner teeth prevents the body lock ring carrier 15 from moving the body lock ring 10 along the mandrel in the opposite direction 19. Conventional body lock rings generally have a 90 degree face on both the inner and outer teeth. The 90 degree angles may actually be only 85 degrees on conventional body lock rings to allow the body lock ring to be manufactured more easily. Both the conventional body lock rings and the body lock ring 10 of the present disclosure will ratchet along the mandrel 20 in one direction 19 and will lock to the mandrel 20 when pushed in the other direction 18. However, conventional body lock rings will not allow the reverse motion of the mandrel 20 to return the mandrel 20 to its original position when the body lock ring 10 is anchored.

The teeth 12 on the interior surface of the body lock ring 10 of FIG. 6 have been modified to allow the mandrel 20 to be moved to its original position. Specifically, the angle of face 13 of the inner teeth 12 has been swept back such that the body lock ring 10 may ratchet in the direction 19 along the mandrel 20 as it is moved back. This occurs when pressure is applied to the lower side of the piston 40 (not shown in FIG. 6) and the piston 40 pulls the mandrel 20 upwards to its original position. The body lock ring 10 ratchets along the mandrel 20 as the body lock ring 10 is anchored to the top connector 130 by the body lock ring holder 110 and the radial pins 100. The actual angle at which the face 13 of the inner teeth 12 is swept back may be modified with differing degrees depending on the application as would be recognized by one of ordinary skill in the art having the benefit of this disclosure.

Figure 13:
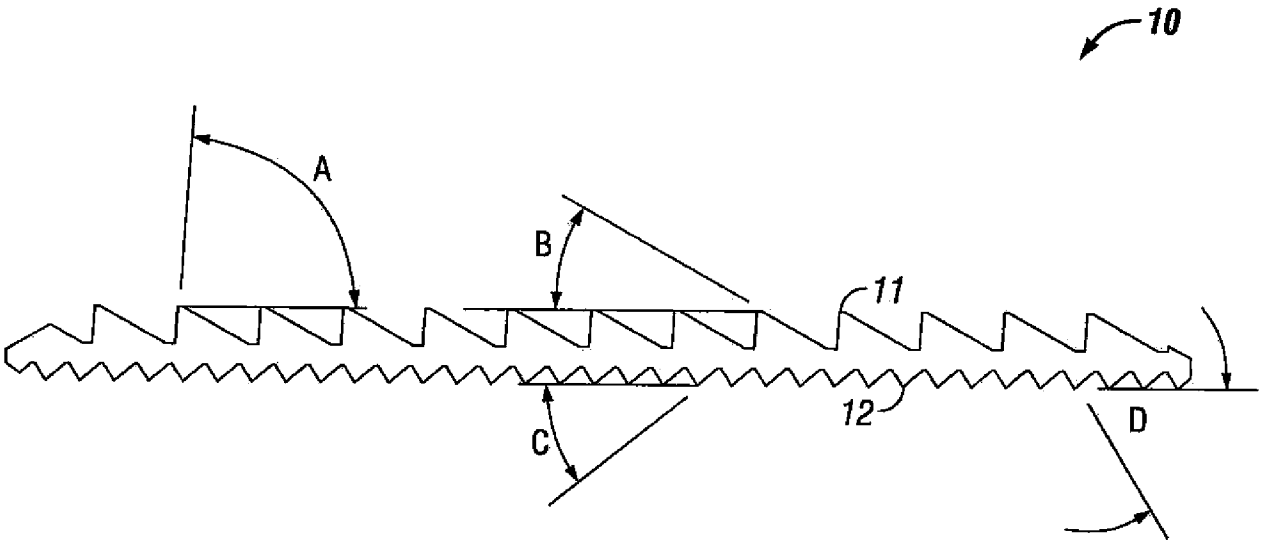
FIG. 13 is a cross-section of one embodiment of the body lock ring 10 of the present disclosure.

FIG. 13 illustrates one embodiment of the body lock ring 10 of the present disclosure and the modification to the inner teeth 12 of the body lock ring to function like a convention body lock ring and also to allow the body lock ring 10 to ratchet along a mandrel when the mandrel is moved upwards to its original position. Angle A of the outer teeth 11 would preferably be 90 degrees to engage the teeth of the body lock ring carrier 15 (not shown). However, angle A may range between 80 to 95 degrees and still sufficiently provide a face to engage with the teeth of the body lock ring carrier as would be appreciated by one of ordinary skill in the art having the benefit of this disclosure.

Angle D of the inner teeth 12 must be small enough to allow the body lock ring to ratchet along the mandrel. The maximum that Angle D may be is approximately 70 degrees. Angle B of the outer teeth 11 should be at least 20 degrees less than angle D of the inner teeth 12 to allow the body lock ring 10 to clamp to the mandrel. The maximum angle for Angle C of the inner teeth 12 is approximately 70 degrees. Angle C must be small enough to allow the body lock ring to ratchet along the mandrel and angle C should be at least 20 degrees less than angle A of the outer teeth 11.

Figure 7:
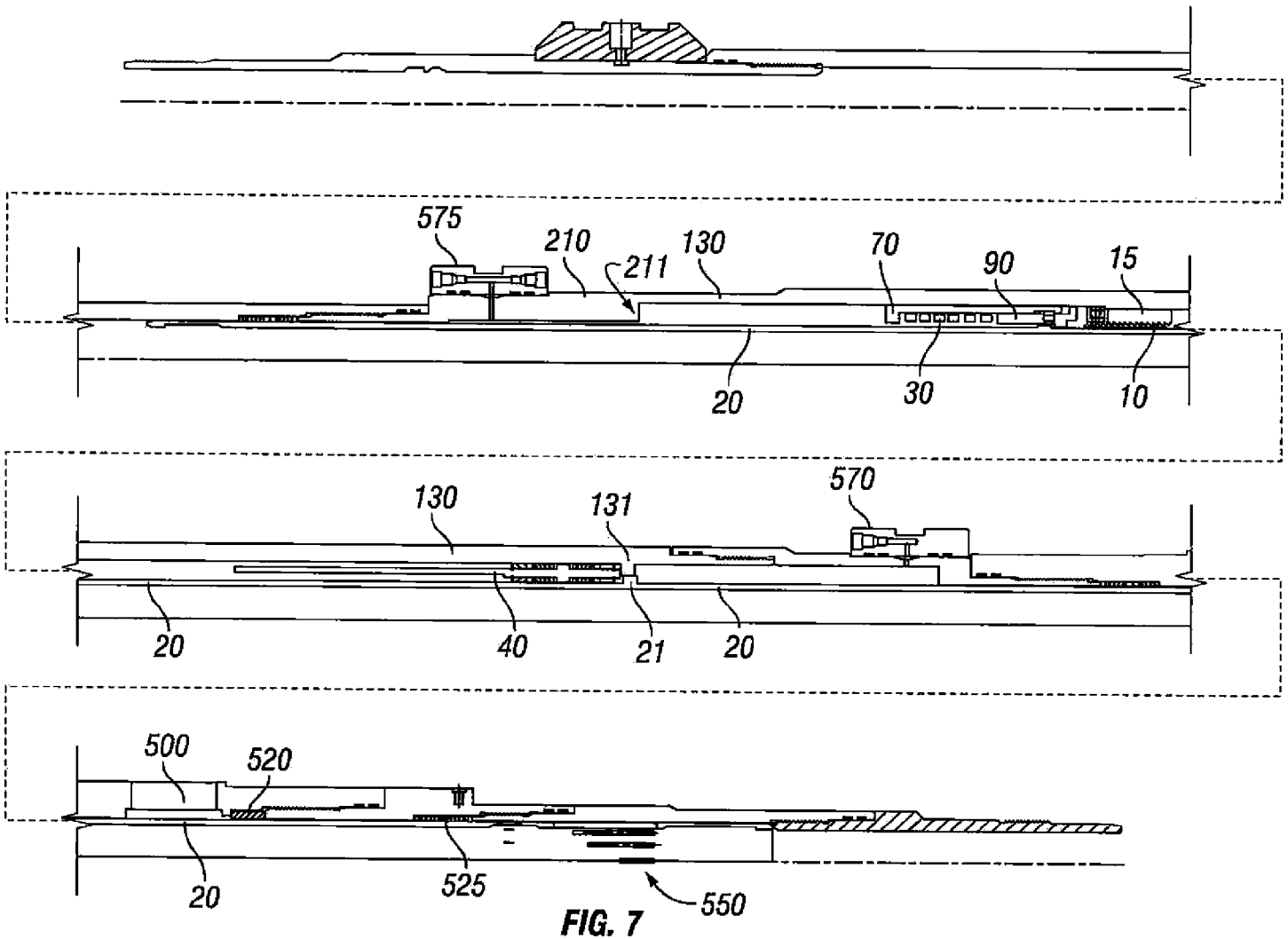
FIG. 7 is a cross-section of one embodiment of the step ratchet mechanism in its initial position.

FIG. 7 is a cross-section view of the step ratchet mechanism used in conjunction with adjustable orifices. FIG. 7 depicts the mechanism in the initial state. In the initial state the piston 40 is located against stop 131 of the top connector. The orifices 550 are located to the right of seals 525 and thus, no fluid is flowing through the fluid port 500. As discussed above, pressure is applied to the system and the piston 40 moves away from the fluid port 500 until it contacts the body lock ring carrier 15. The pressure causes the body lock ring to engage the mandrel 20 and the movement of the piston also causes the movement of the mandrel away from the fluid port 500. By way of example, pressure may be applied to the system via hydraulic connector 570 which is in fluid communication with piston 40. A hydraulic line (not shown) is connected to connector 570 and extends to the surface. Pressure is applied through connector 570 to move piston 40 to open the valve mechanism. The embodiment shown in FIG. 7 includes a restrictor ring 520. The restrictor ring 520 may be comprised of erosion resistant material that allows minimal flow past it to the fluid port 500.

Figure 8:
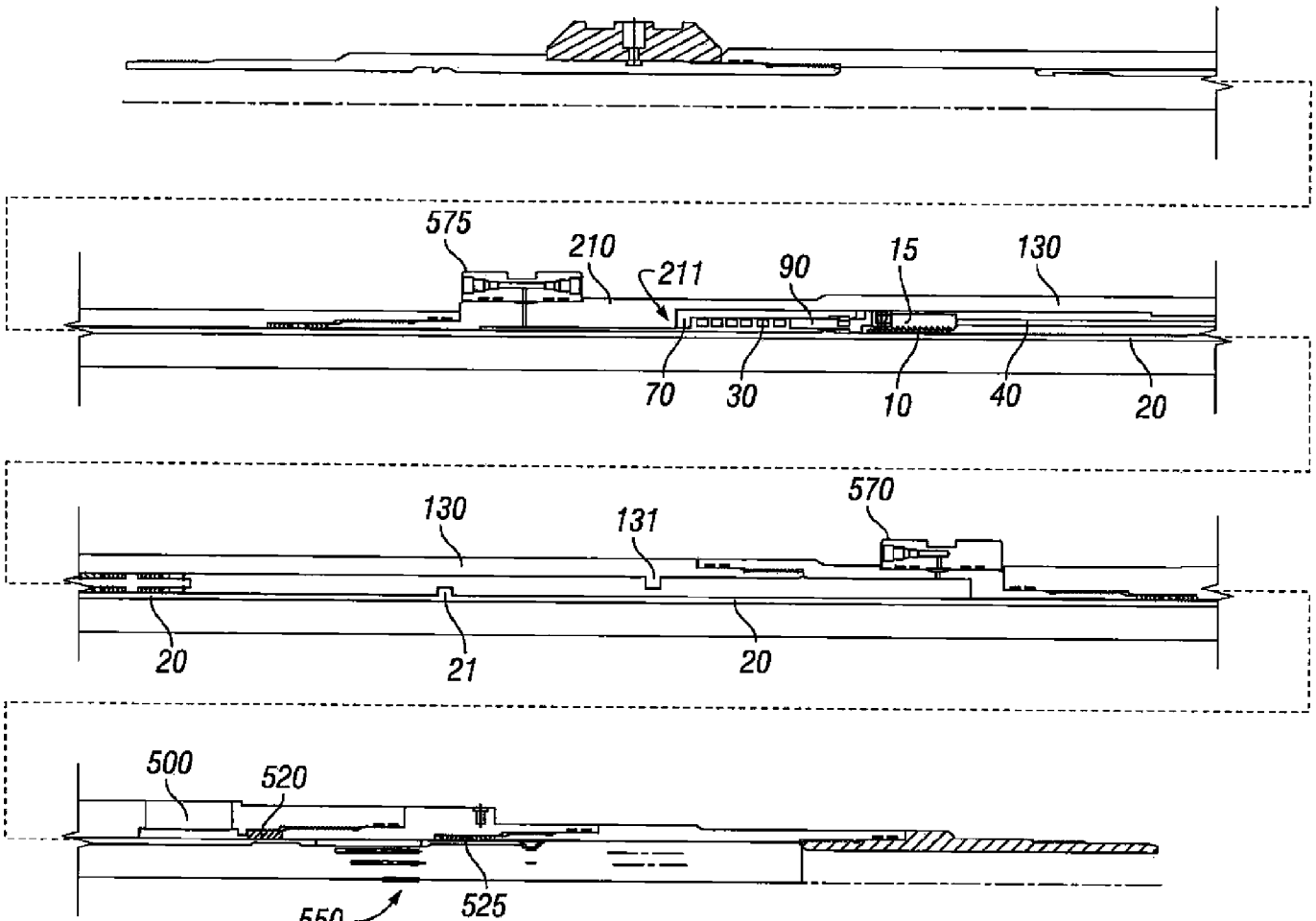
FIG. 8 is a cross-section of the step ratchet mechanism of FIG. 7 after the pressure cycle has been applied once to the system.

FIG. 8 illustrates that embodiment of FIG. 7 after the first pressure cycle has been applied to the system. The piston 40 has engaged the body lock ring carrier 15 moving the body lock ring carrier 15, the body lock ring 10, the mandrel 20, the spring lock 90 and the spring holder 70 away from the fluid port 500. The spring holder 70 has contacted shoulder 211, thus further movement of the mandrel 20 will be limited to the incremental distance required for the spring lock 90 to compress the spring 30 within the spring holder 70. After the first pressure cycle, the orifices 550 have move completely past the seals 525 and thus, the seals 525 are protected from damage. The restrictor ring 520 will still limit minimal flow to the fluid port 500 when the orifices 550 are in this position.

Figure 9:
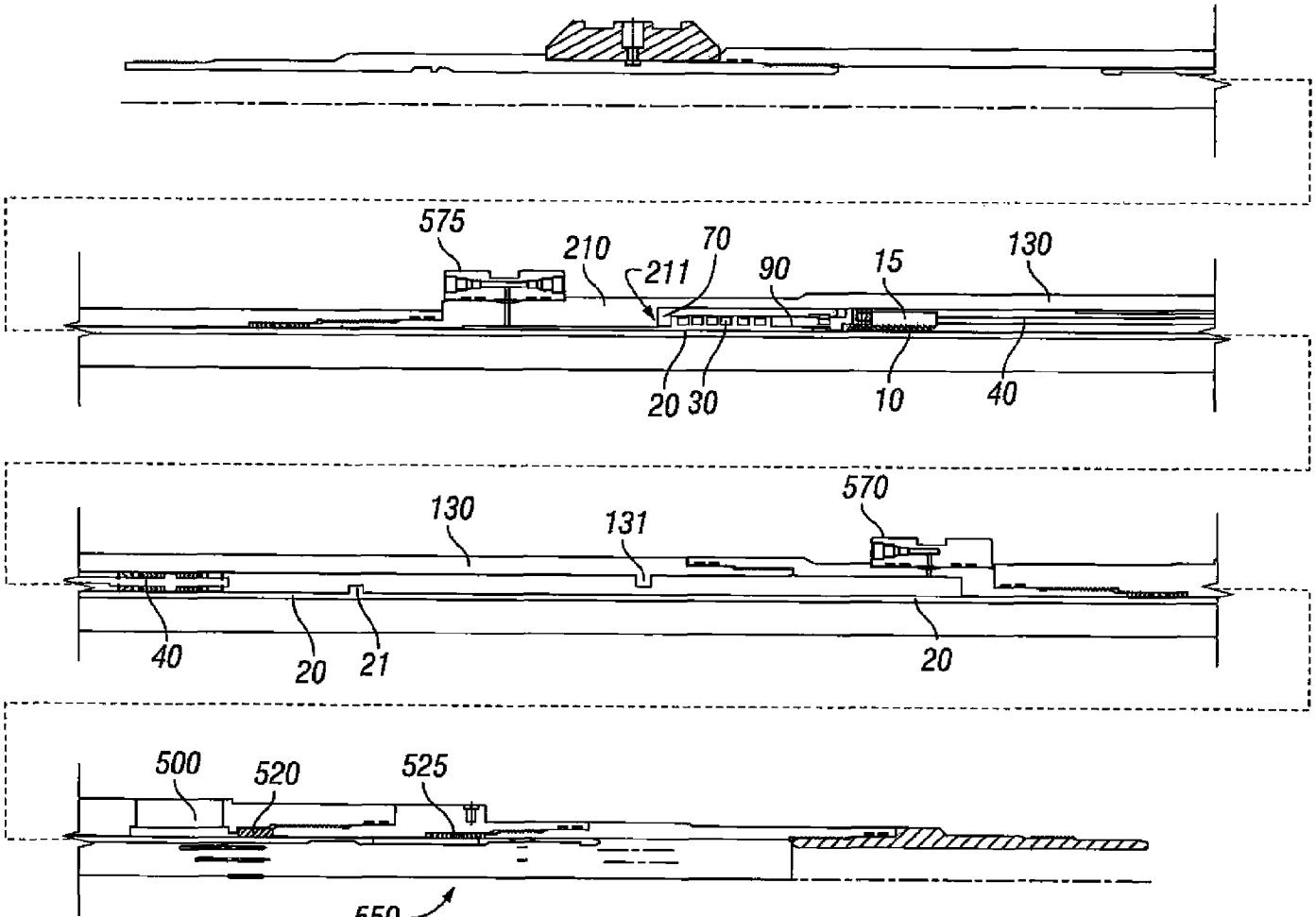
FIG. 9 is a cross-section of the step ratchet mechanism of FIG. 7 that has been cycled a number of times such that the flow orifices are in a position they may remain during production through the fluid port 500.

FIG. 9 illustrates the position of the adjustable orifices 550 partially past the restrictor ring 520 after a number of pressure cycles have been applied to the system. This may be the position the system would be left in during production through the fluid port 500. As the downhole reservoir is depleted, one or two pressure cycles may be applied to the system to move the orifices 550 farther past the restrictor ring 520 increasing the flow path through fluid port 500.

Figure 10:
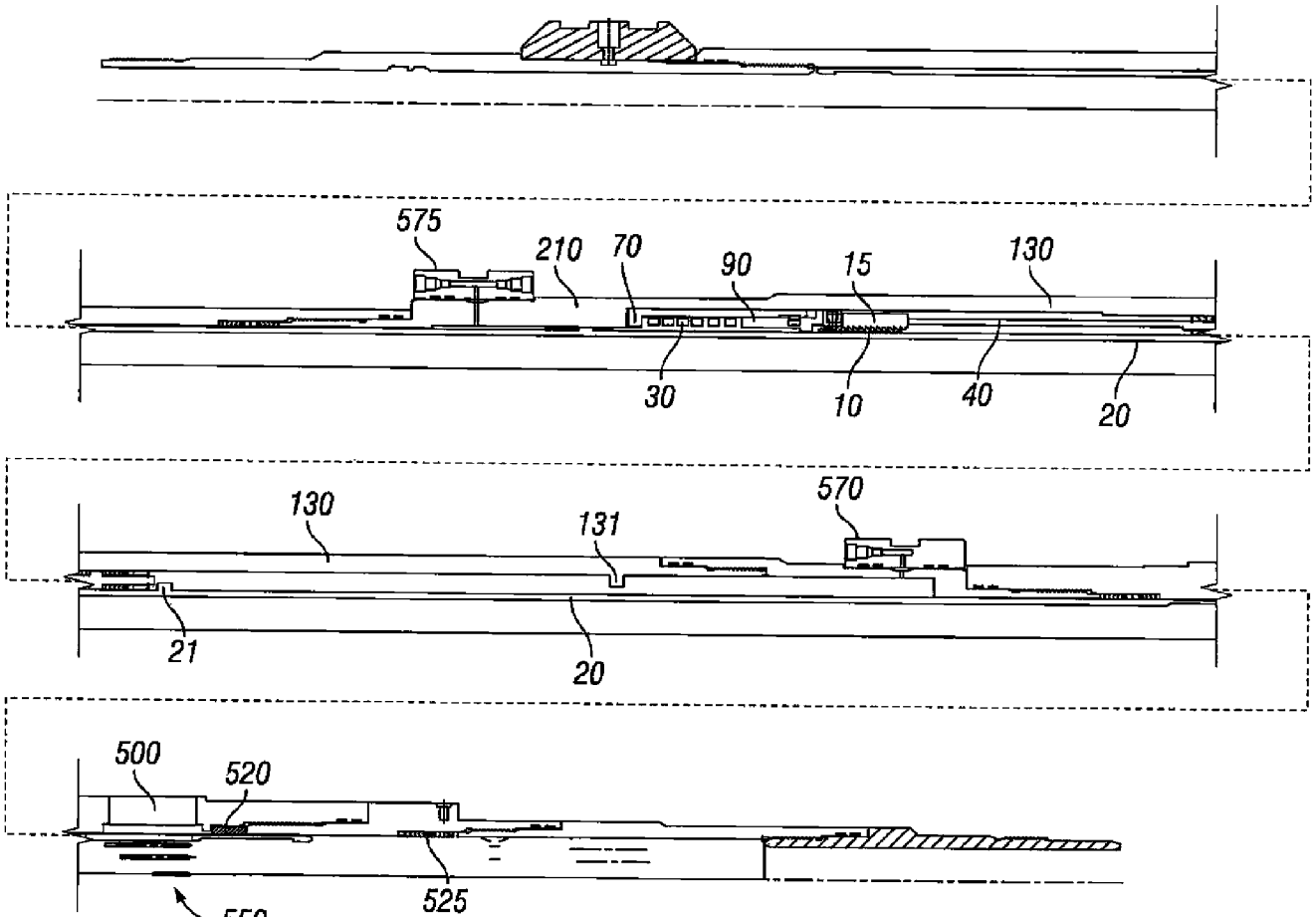
FIG. 10 is a cross-section of the step ratchet mechanism of FIG. 7 that has been repeatedly cycled until the mandrel has moved to its final position completely opening the flow orifices 550 in fluid communication with fluid passage 500.
Figure 11:
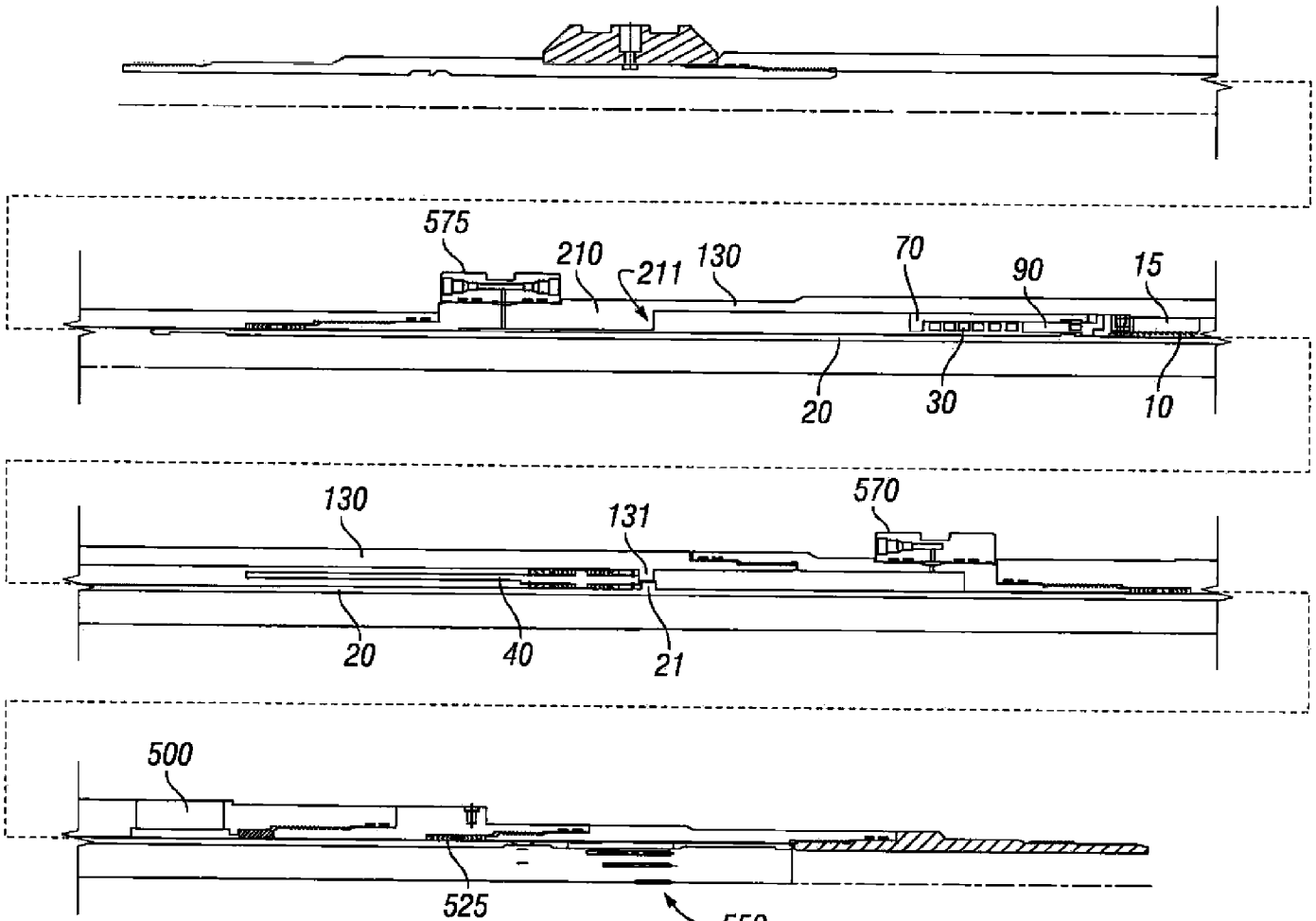
FIG. 11 is a cross-section of the step ratchet mechanism of FIG. 7 that has been returned to the initial position, thus closing the flow orifices 550.

FIG. 10 illustrates the adjustable orifices 550 fully open and the step mechanism completely cycled. The adjustable orifices 550 are completely aligned with the fluid port 500 allowing maximum fluid flow. The piston 40 engages the body lock ring carrier 15 and further cycles are prevented by the mandrel stop 21 contacting the upper portion of the piston 40. FIG. 11 illustrates the adjustable orifices 550 located in the fully closed position located to the right of the seals 525. The seals 525 prevent any fluid flow between the orifices 550 and the fluid port 500. The adjustable orifices are returned to the closed position when the mandrel is returned to the initial position as indicated by the alignment of the mandrel stop 21 with the top connector stop 131. Back pressure is applied to the system moving the mandrel 20, body lock ring assembly, spring holder 70, and the piston 40 to their original positions. Closing pressure is applied through a closing line (not shown) that extends from the surface to hydraulic connector 575. Hydraulic connector 575 is in fluid communication with the opposite side of piston 40. Connector 575 provides an additional outlet for connecting the closing line (not shown) to additional valve assemblies should it be desirable to run a plurality of assemblies in series.

The adjustable orifices and fluid port of the embodiments of FIGS. 7-11 are shown for illustrations purposes and are but one embodiment of the present disclosure. The actual configuration of an adjustable orifices used in conjunction with the step ratchet mechanism may be varied as would be appreciated by one of ordinary skill in the art. Further, the step ratchet mechanism is applicable to drive a varying number of downhole multi-position devices as would be appreciated by one of ordinary skill in the art.

Figure 12:
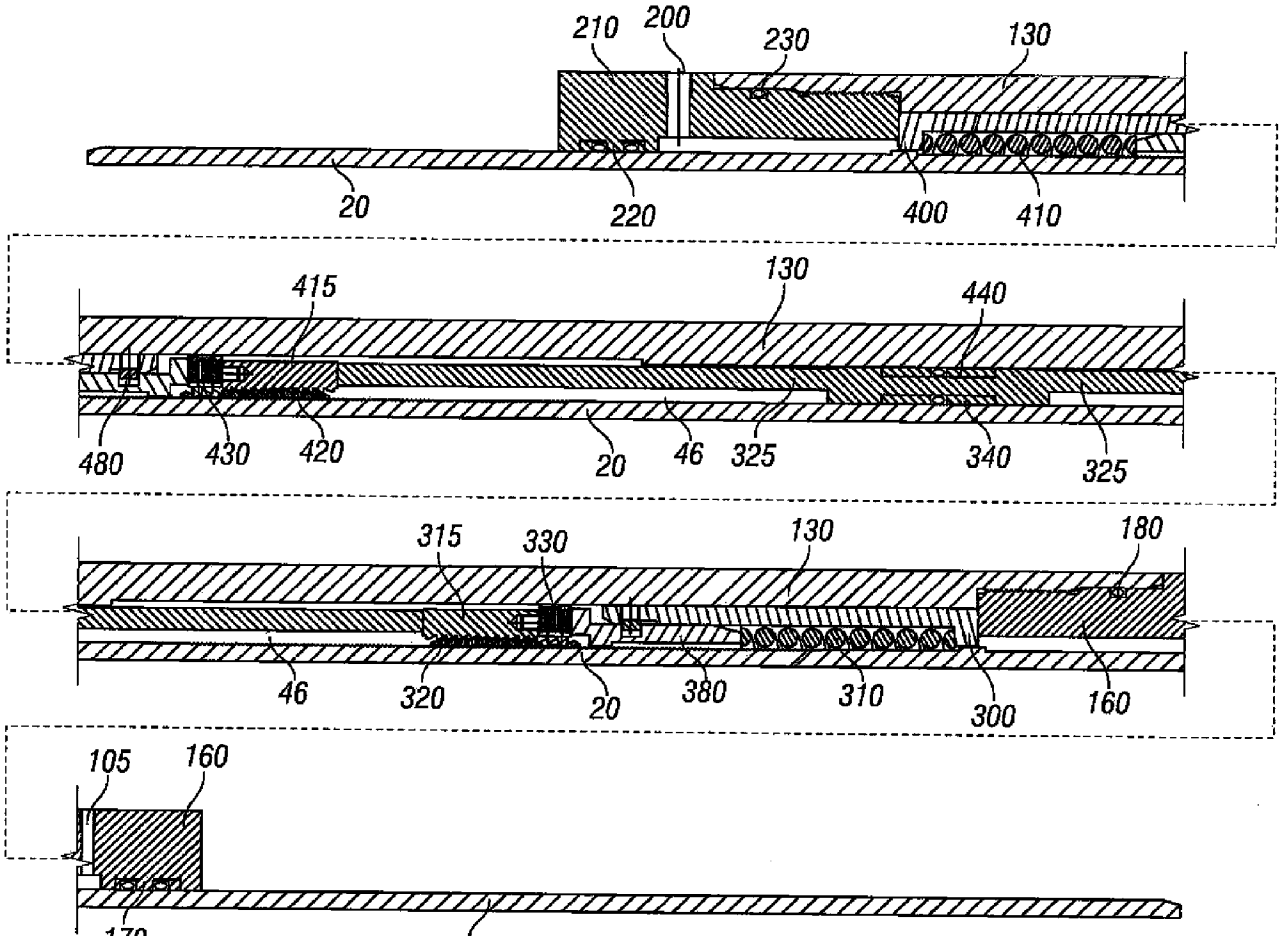
FIG. 12 is an embodiment of the step ratchet mechanism that provides for ratcheting movement in both directions.

FIG. 12 shows one embodiment of the present disclosure that provides for ratcheting movement in both directions along a mandrel 20. An upper step ratchet mechanism comprising a spring holder 300, a spring 310, a spring lock 380, a body lock ring holder 330, a body lock ring carrier 315, and a body lock ring 320 may be connected to one end of a piston 325. A lower step ratchet mechanism comprising a spring holder 400, a spring 410, a spring lock 480, a body lock ring holder 430, a body lock ring carrier 415, and a body lock ring 420 may be connected to the other end of the piston 325. The components may be connected and configured as the other embodiments as discussed above.

The piston 325 and the upper and lower step ratchet mechanism travel along a chamber located between a top connector 130 and a mandrel 20. The upper and lower step ratchet mechanisms may be positioned adjacent an upper adapter 160 and a lower adapter 210 respectively. Pressure may be introduced into the chamber via ports 200 or 105. The pressure causes the mandrel to move. The presence of the upper and lower step ratchet mechanisms causes the location of the mandrel to ratchet in either direction. The body lock rings 320, 420 engage the teeth on the mandrel 20 as discussed above. This configuration allows for the incremental movement of the system in either direction if needed.

Figure 14:
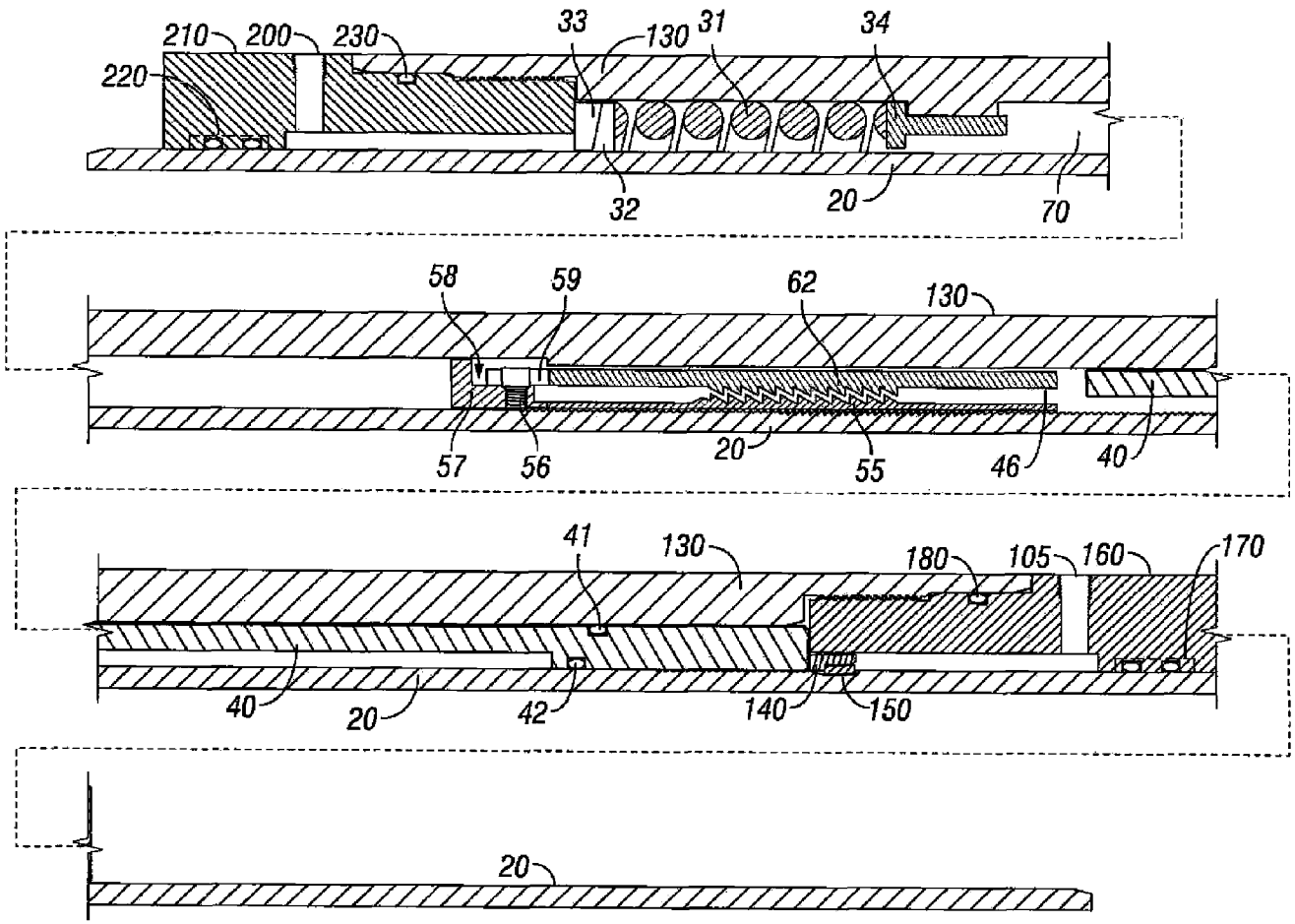
FIG. 14 is a cross-section view of one embodiment of a step ratchet mechanism that includes a double ended body lock collet 55.
Figure 15A:
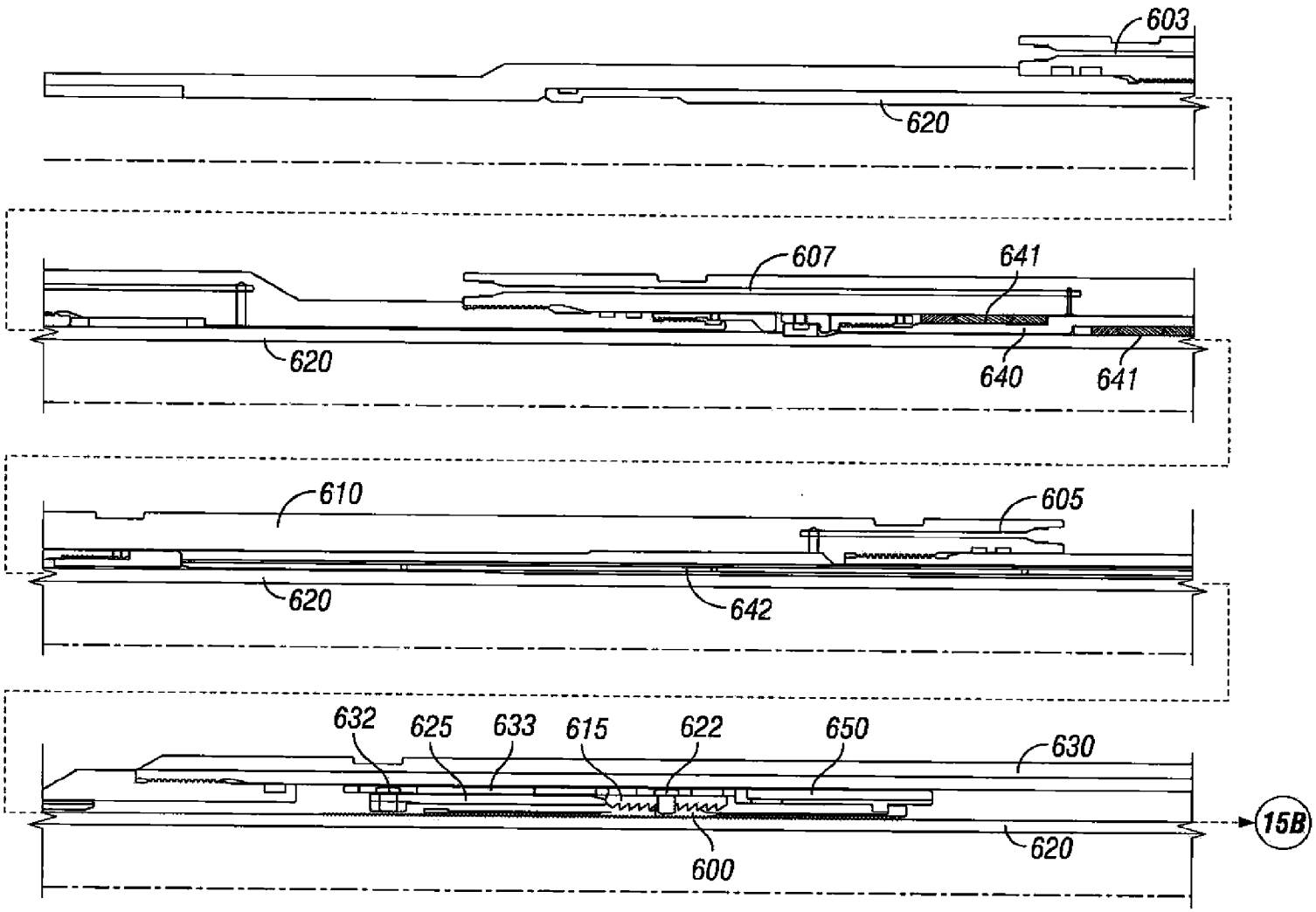
FIGS. 15A and 15B are a cross-section of another embodiment of the step ratchet mechanism in its initial position.
Figure 15B:
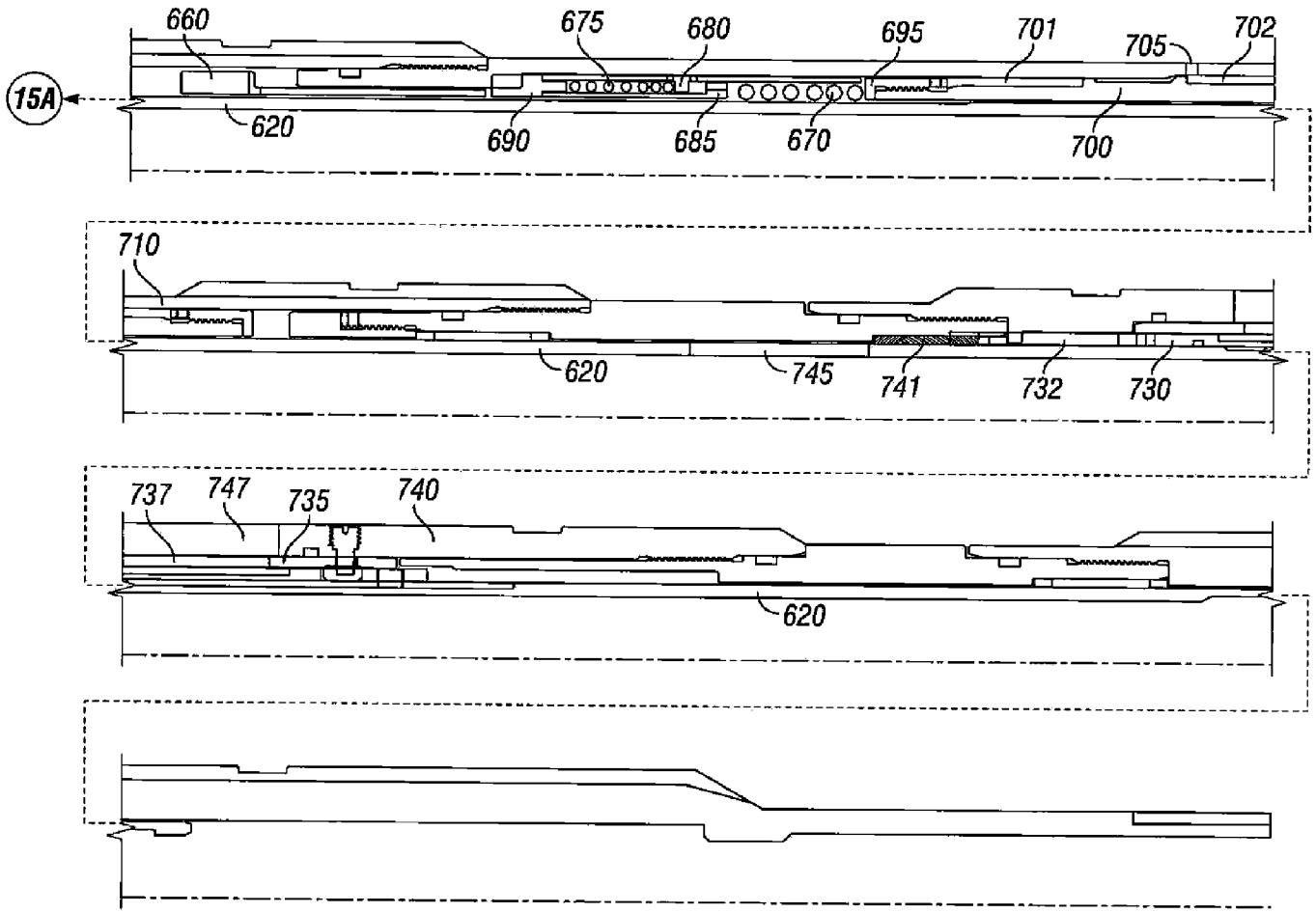

FIG. 14 shows an embodiment of the present disclosure that uses a double ended body lock collet 55 and a collet carrier 62 in place of the body lock collet 50 shown in FIG. 2. The mechanism operates in a similar manner as the embodiment of FIG. 2. Pressure is applied to the system and the piston 40 moves within a chamber of the step ratchet mechanism pushing the doubled ended body lock collet assembly down the top connector 130 away from the upper adapter 160. The pressure causes the interior teeth of the body lock collet 55 to engage teeth on the exterior of the mandrel 20 thus, also moving it along the top connector 130 away from the upper adapter 160. The double ended body lock collet assembly will continue to move along the top connector 130 until it contacts a cylinder 34. The cylinder 34 is positioned adjacent to one end of a spring 31 that is located within the chamber of the step ratchet mechanism. When the double ended body lock collet assembly contacts the cylinder 34, the pressure is increased until the cylinder 34 completely compress the spring 31 located within the chamber. The use of the spring 31 positioned within the chamber and not within a spring housing, as shown in FIG. 2, provides for more variation in the incremental distance moved during each pressure cycle and allows the use of a stronger spring.

The lower end of the double ended body lock collet 55 may include an upset 57 and a screw 56 in order to prevent rotation between the double ended body lock collet 55 and the body lock collet carrier 62. The screw 56 may be positioned within a slot 59 (or oversized hole) of the body lock collet carrier 62 as shown in FIG. 14. The length of the body lock collet carrier 62 may provide a gap 58 between the end of the body lock collet carrier 62 and the upset 57. The gap provides sufficient space for collet carrier 62 to move downward to engage the threads of body lock collet 55. The step mechanism may also include a friction ring 32 positioned adjacent to a second end of the spring 31 and a beveled ring 33 positioned adjacent to the friction ring 32. The friction ring 32 may be a split ring that is forced against the mandrel 20 by the beveled ring 33 as the spring 31 is compressed within the chamber of the mechanism. The friction ring helps increase friction to maintain the mandrel in a stationary position when the body lock ring is being pushed back up the mandrel.

FIGS. 15-18 illustrate another system that utilizes the step ratchet mechanism of the present invention in conjunction with adjustable orifices. FIGS. 15A and 15B illustrate the system in the initial position with the adjustable orifices in the closed position. FIGS. 16A and 16B illustrate the first stroke of the pressure cycle on the system. FIGS. 17A and 17B illustrate the final stroke of the system with the adjustable orifices in the fully opened position. FIGS. 18A and 18B illustrate the system after the power piston and mandrel have been reset, closing the orifices.

In this embodiment, the step ratchet mechanism includes a double ended collet 600, collet carrier 615, power piston 640, and mandrel 620. The lower portion of the mandrel includes one or more flow slots 745 that may be positioned relative to one or more radial flow ports 747 in an outer orifice housing to provide an adjustable flow orifice as more fully described below. Piston 640 is positioned in a chamber formed by mandrel 620 and piston housing 610. The piston is in fluid communication with opening port 603 that extends through piston housing 610. The opening port terminates at a hydraulic connector for connecting a hydraulic control line (not shown) which extends to the surface of the well. Piston 640 includes upper and lower seal stacks 641 which seal against the inner diameter of the piston housing and the outer diameter of the mandrel respectively. When pressure is applied through the opening port, piston 640 will move from the initial position shown in FIG. 15A to the position shown in FIG. 16A. Piston housing 610 includes a return or close port 605 which, like the opening port, terminates on one end at a hydraulic connector for a hydraulic control line (not shown). Surface pressure can be applied through the control line, through port 605 to move piston 640 back to its initial position, shown in FIG. 18A. Piston spacer 642 abuts one end of piston 640 and is slidably received within the piston chamber and moves with the piston.

Double ended collet 600 is a cylindrical shaped sleeve having a plurality of longitudinal slots in the sleeve so the center section of the collet (i.e., the collet fingers) can expand and contract. By way of example, the collet has eight longitudinal slots that are located equally about the cylindrical sleeve creating a number of flexible fingers with both ends of the fingers fixed. The collet includes an upset area proximate the middle of each flexible finger with threads on the internal surface for engaging mandrel 620 and larger, coarser threads on the external surface for engaging collet carrier 615. The ratchet assembly preferably includes one or more pins 622 that prevent rotation between the collet 600 and carrier 615 to maintain alignment of the mating threads. Anti-rotation pin 622 extends through a slot in ratchet housing 650. Pusher sleeve 625 is mounted to ratchet spacer 633 by pin 632. Ratchet spacer 633 and ratchet housing 650 collectively contain the pusher sleeve, the collet carrier and the double ended collet, the entire assembly being slidably received within top connector 630.

Figure 16A:
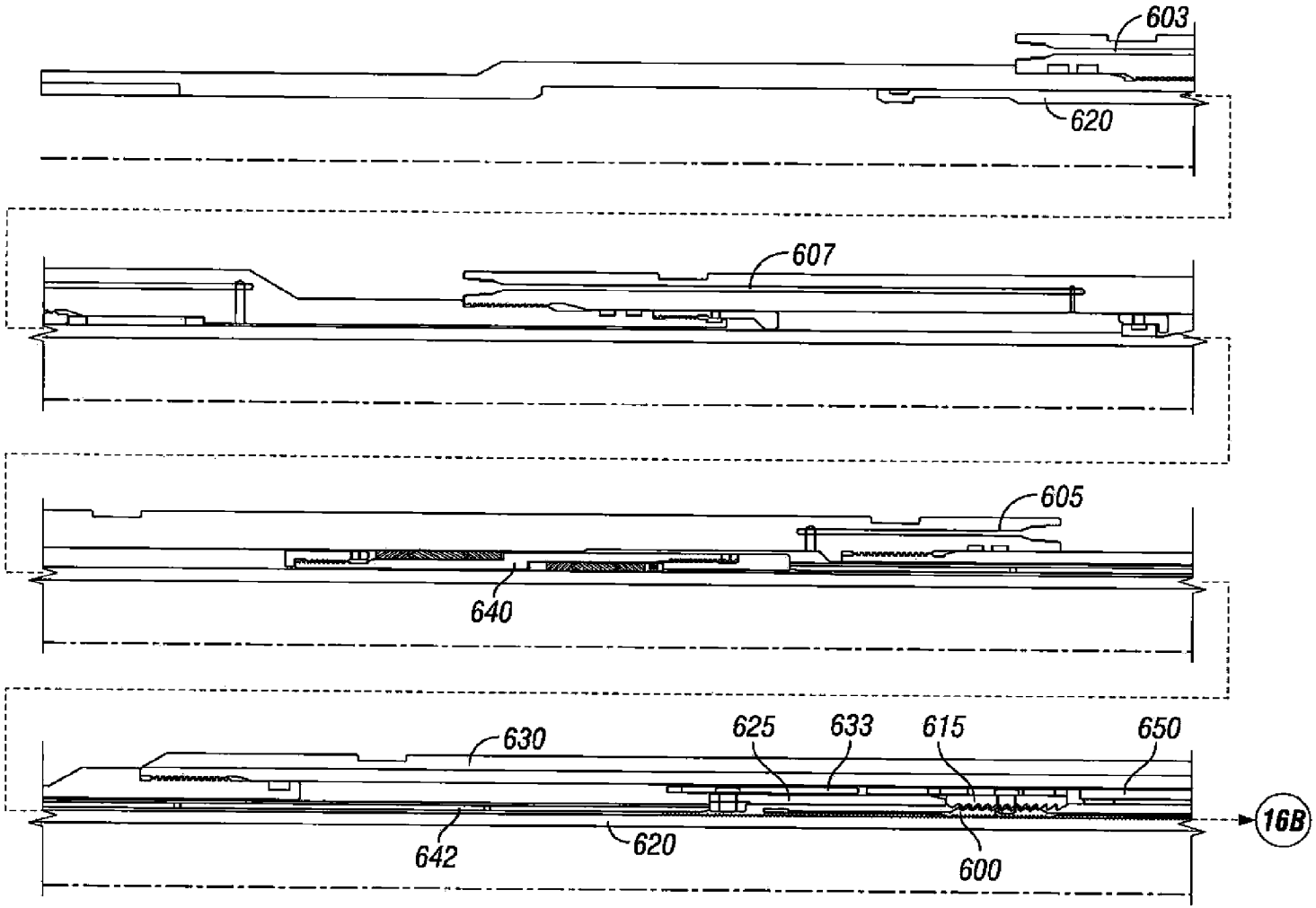
FIGS. 16A and 16B are a cross-section of the step ratchet mechanism of FIGS. 15A and 15B after the pressure cycle has been applied once to the system.

Pusher sleeve 625 abuts collet carrier 615 and pushes against the carrier when contacted by piston spacer 642, as shown in FIG. 16A. Piston spacer 642 contacts the pusher sleeve when pressure is applied to power piston 640, as described below. Collet carrier 615 in turn pushes against a shoulder of ratchet housing 650. The collet carrier rides on the shallow angle side of the outer threads of collet 600 and pushes the collet down, causing the collet to clamp onto the threads of mandrel 620. Thus, piston spacer 642 will apply a force to the collet carrier via the parts of the ratchet assembly causing the collet to clamp down on the mandrel wherein the entire assembly and mandrel may be moved down.

The ratchet mechanism of FIGS. 15-18 includes a double spring arrangement comprising primary spring 670 and secondary spring 675 which operate in parallel to provide more spring force. Secondary spring 675 is contained between the upper portion of outer spring sleeve 680 and the inner spring sleeve 685. Primary spring 670 is contained between the lower portion of the outer spring sleeve and mandrel 620. Sleeve connector 690 connects the inner spring sleeve to the outer spring sleeve. Spring pusher 660 extends from the double spring arrangement and, as shown in FIG. 16B, is used to compress the springs when contacted by ratchet housing 650. When contacted by the ratchet housing, spring pusher applies a force to connector 690, which in turn causes secondary spring 675 to compress against an inward shoulder radially extending from the outer spring sleeve. Simultaneously, the inner spring sleeve compresses primary spring 670 against stop 695. As with previous embodiments, the double spring arrangement will return the collet and collet carrier up relative to the mandrel when pressure is bled off piston 640 and the spring returns to its non-compressed state. Thus, by cycling the opening pressure on and off, the mandrel can be incrementally moved downward toward the flow orifice mechanism. The ability to incrementally move the mandrel in a controlled fashion allows for an adjustable flow orifice, as described.

The double spring arrangement abuts ratchet return piston 700. In the event that springs 670 and 675 fail, ratchet return piston can be hydraulically actuated to operate the valve. Piston 700 has two seal stacks 701 and 702 on its exterior surface to provide a piston area between the piston and the inner diameter of spring housing 710. A port 705 extends through the spring housing to provide communication between the annulus and the piston area. To operate ratchet return piston 700, pressure, for example 500 psi, is applied to the return port 605. A larger pressure is applied to the opening port to push the power piston to the position shown in FIG. 16A. To incrementally move the ratchet assembly up the mandrel via the return piston, the opening line pressure is bled to the same pressure (in this example 500 psi) in the return line. The return pressure is felt on return piston 700 and exceeds the annulus pressure applied through port 705. This pressure differential causes the return piston to move upwardly, pushing the ratchet assembly up relative to the mandrel. Under the conditions described, the ratchet return piston will act in substantially the same way as the double spring arrangement. One of skill will appreciate that the ratchet return piston may be used with other spring arrangements, such as the spring arrangements describe in the other embodiments of the invention. Increasing the pressure in the opening line again will cause the power piston to incrementally move the mandrel down. These steps can be repeated as desired until the systems orifice is fully opened as depicted in FIG. 17.

Figure 16B:
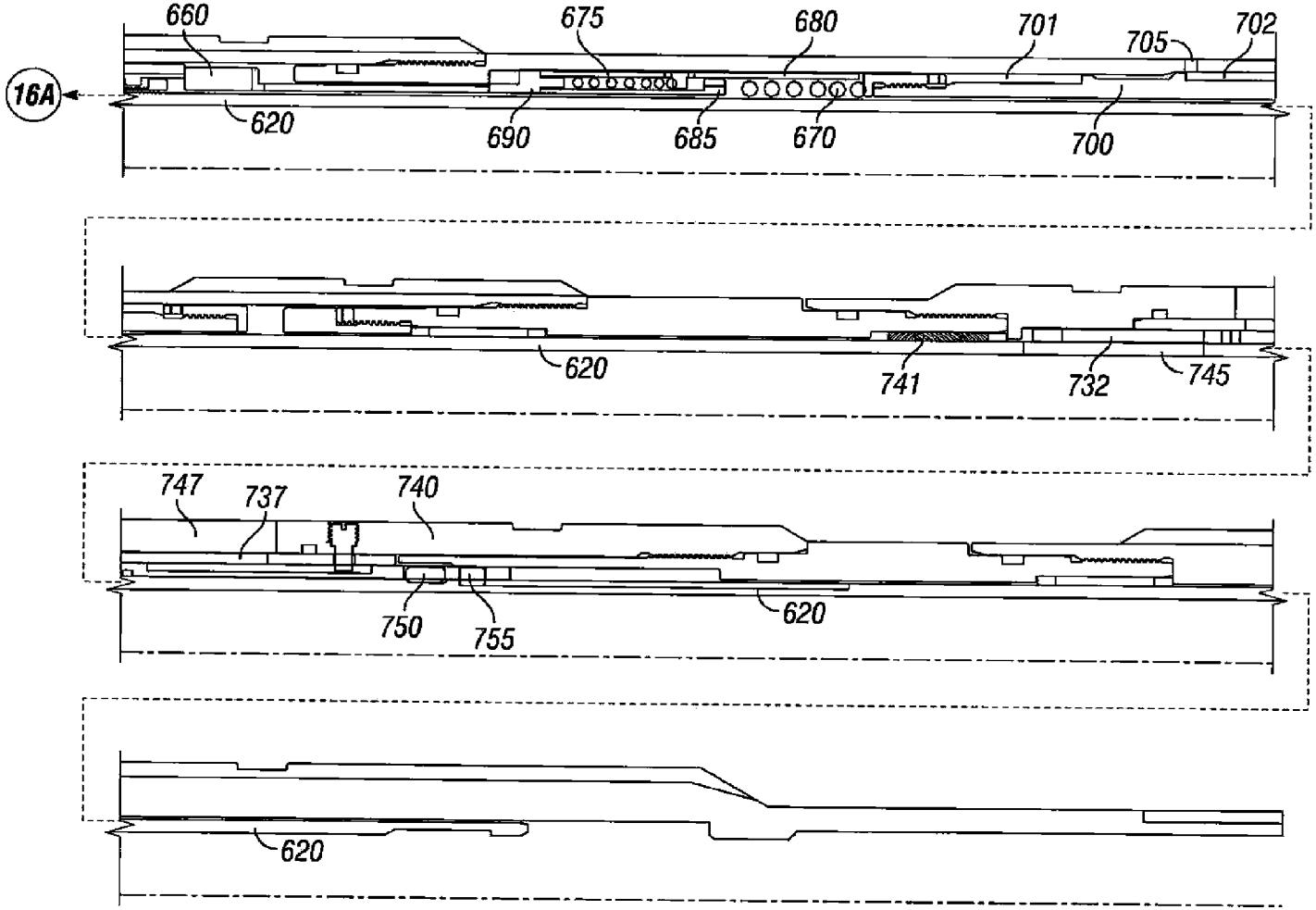

The adjustable flow orifice preferably includes outer orifice sleeve 735 and inner orifice sleeve 730, both sleeves made of wear resistant carbide or other hard material. The outer orifice sleeve 735 is fixed to outer housing 740 and includes flow slots 737 which are substantially aligned with flow ports 747 in outer housing 740. When the power piston is moved from its initial position to the position shown in FIG. 16A, mandrel 620 also moves downwardly allowing flow slots 745 in the mandrel to move past seal stack 741 sealing the upper end of the outer housing. Mandrel flow slots 745 substantially align with flow slots 732 in the inner orifice sleeve, as shown in FIG. 16B. Pins 752 extend from sleeve 730 into mating key slots in the mandrel. Pins 752 keep the mandrel flow slots 745 radially aligned with flow slots 732. Once the pins contact the ends of the key slots, one or more dogs 750 drop into a recess in the outer diameter of the mandrel to lock the inner orifice sleeve to the mandrel, thereby allowing the inner orifice sleeve to move with mandrel 620.

Figure 17A:
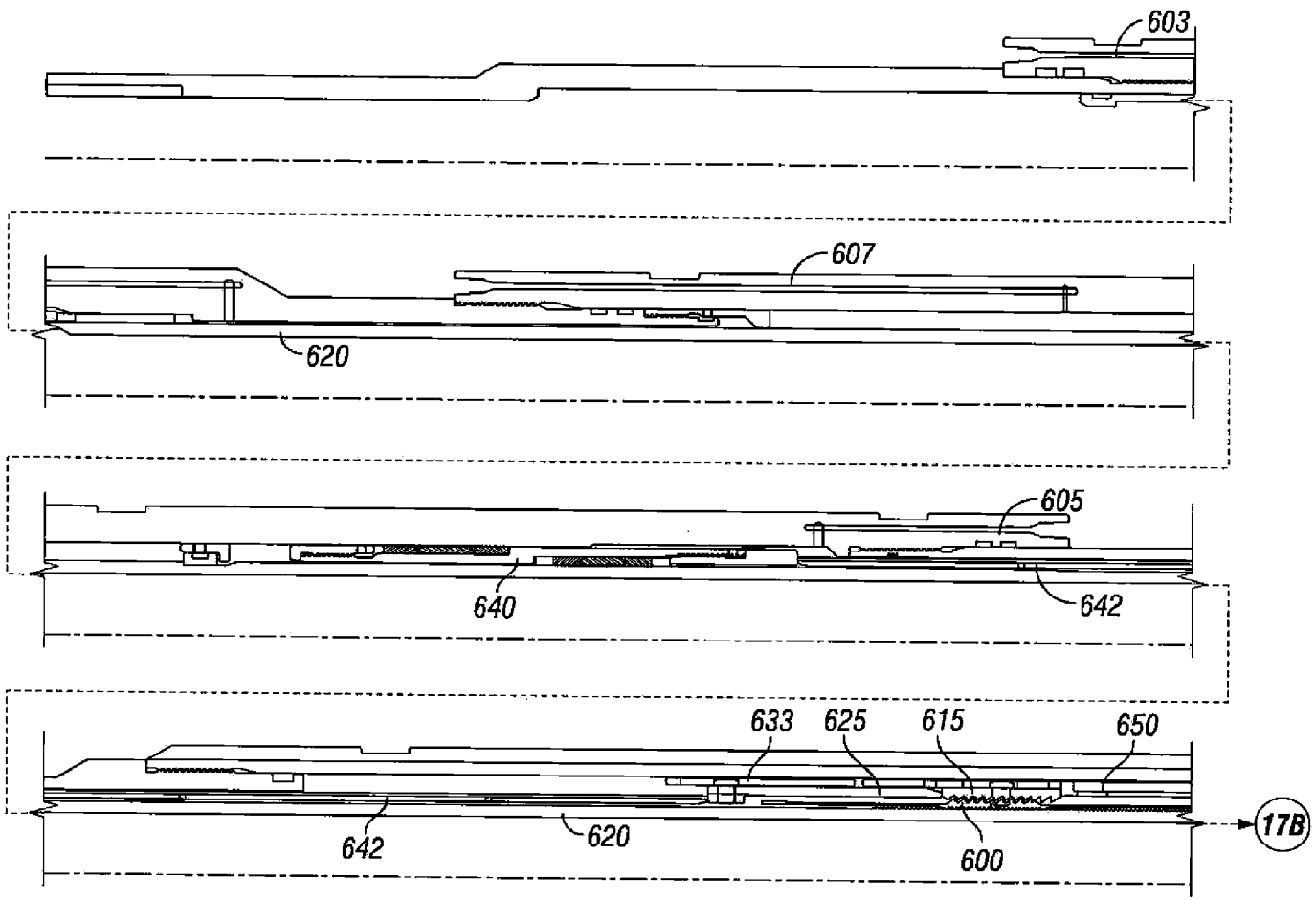
FIGS. 17A and 17B are a cross-section of the step ratchet mechanism of FIGS. 15A and 15B that has been cycled a number of times such that the flow orifice is in a fully opened position.
Figure 17B:
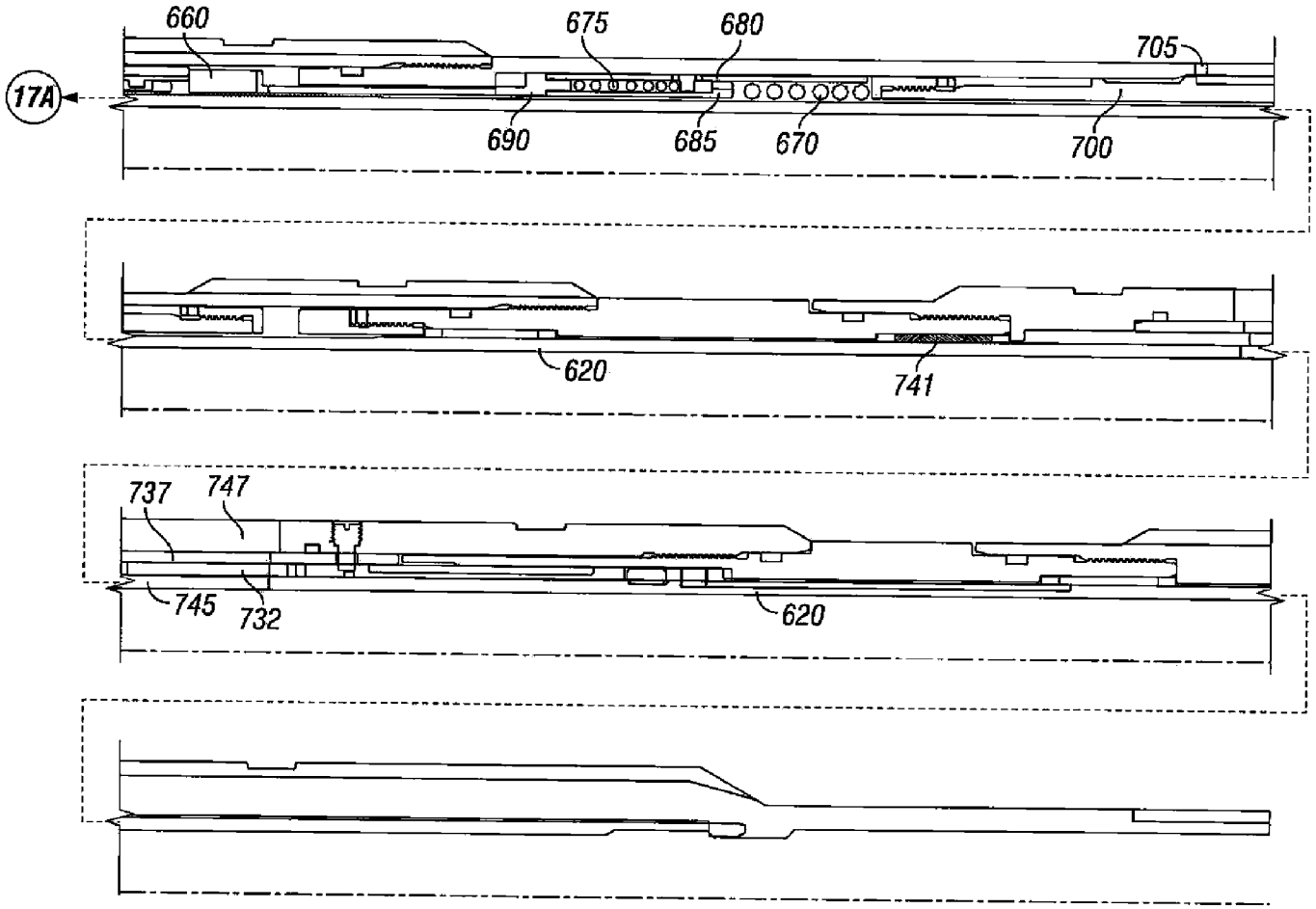
Figure 18A:
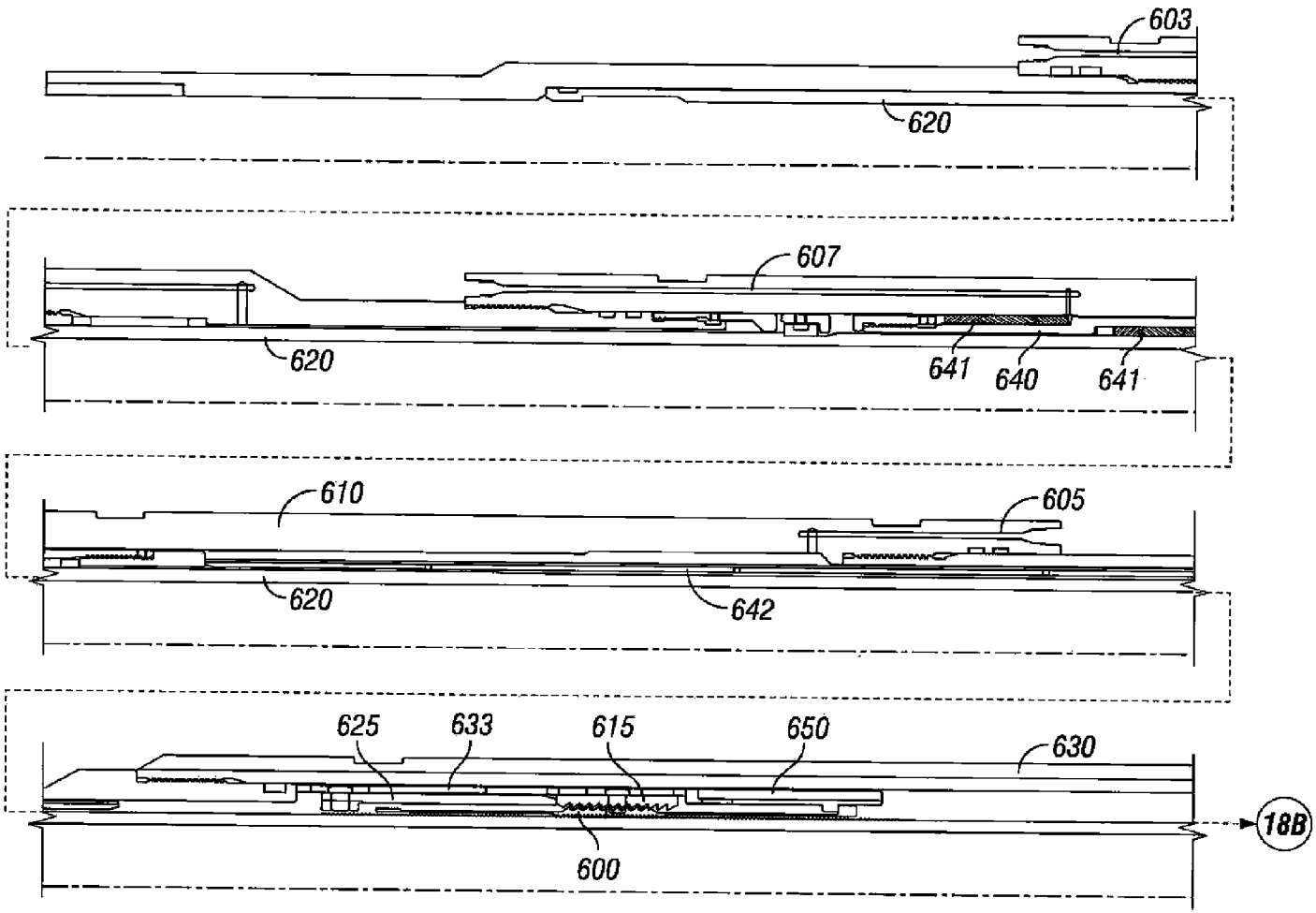
FIGS. 18A and 18B are a cross-section of the step ratchet mechanism of FIGS. 15A and 15B that has been returned to the initial position, thus closing the flow orifice.
Figure 18B:
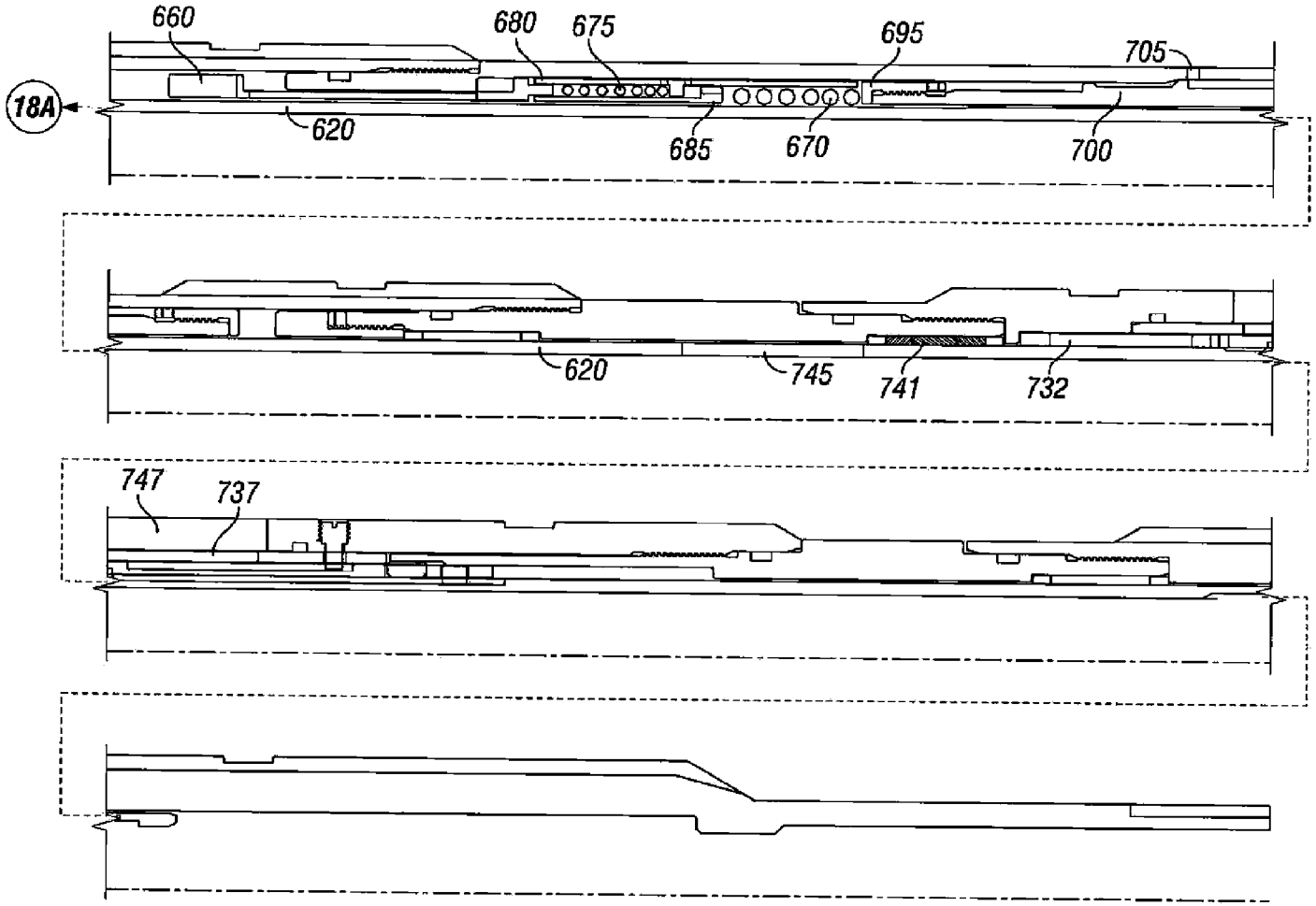

As the mandrel is incrementally moved downwardly, slots 732 in the inner orifice sleeve will gradually align with slots 737 in the outer orifice sleeve to allow flow through the adjustable orifice. Pin 755 prevents rotation between the outer housing and the inner and outer orifice sleeves to radially align flow ports 747, and slots 737 and 732. The size of the orifice may be adjusted to control the amount of flow through the orifice by incremental movement of the mandrel as described above. FIG. 17B illustrates the orifice in the fully opened position. The carbide inner and outer orifice sleeves provide wear resistance to fluid flow through the orifice.

In one embodiment, piston housing 610 may include an indicator port 607 which is in fluid communication with the piston chamber. A hydraulic connector is provided on the end of the port for a hydraulic line (not shown). The hydraulic line, along with a pressure relief valve, may be tied into the opening line to allow the indicator port to be used to monitor the position of piston 640 and mandrel 620. More particularly, when piston 640 is returned to its initial position, return line pressure will be felt at indicator port 607. When the return line pressure exceeds the opening pressure for the pressure relief valve, return line fluid can circulate from return port 605, through the piston chamber, into indicator port 602, through the pressure relief valve and up the opening control line to the surface, providing a positive indication that the piston is in its initial position and the adjustable orifice is in the closed position. The outer seal stack 641 on piston 640 will prevent the return line fluid from reaching the indicator port until the seal stack passes the port upon the piston's arrival at its initial position. The indicator port also provides a user with a way to circulate out any gas that may be in the hydraulic control lines for the system.

An exemplary embodiment of the present invention provides a step ratchet assembly adapted for movement along a mandrel, the step ratchet assembly comprising: a mandrel having an outer diameter and an outer surface, the mandrel being tubular in shape; a top connector having an inner diameter greater than the outer diameter of the mandrel, the top connector surrounding the mandrel thereby creating a chamber between the mandrel and the top connector; a locking mechanism placed along the chamber, the locking mechanism having an inner and outer surface, the inner surface of the locking mechanism adapted to selectively engage the outer surface of the mandrel; a locking mechanism carrier having an inner and outer surface, the inner surface of the locking mechanism carrier adapted to selectively engage the outer surface of the locking mechanism; and a driving mechanism adapted to drive the locking mechanism and the mandrel, wherein the step ratchet assembly is adapted to move the mandrel in a first direction and a second direction opposite the first direction.

In yet another exemplary embodiment, the driving mechanism comprises: an upper adapter connected to a proximal end of the top connector, the upper adapter having a first port in fluid communication with the chamber; a lower adapter connected to a distal end of the top connector, the lower adapter having a second port in fluid communication with the chamber; and a piston located in the chamber, the piston adapted to be driven up or down in response to fluid pressure applied from the first or second ports. The mandrel may be operatively connected to one or more adjustable orifices and associated fluid ports for the adjustable orifices. In the alternative, the movement of the mandrel permits incremental adjustment of a fluid flow through the adjustable orifices. In other exemplary embodiments, the mandrel is operatively connected to one or more multi-piston devices, the step ratchet assembly further comprises a stop or catch on the mandrel, the stop or catch having a lock ring holder and a ratchet lock ring and/or the locking mechanism is a body lock ring and the locking mechanism carrier is a body lock ring carrier.

In other exemplary embodiments, the locking mechanism is a body lock collet and the locking mechanism carrier is a body lock collet carrier. In the alternative, the locking mechanism is a double ended body lock collet and the locking mechanism carrier is a body lock collet carrier. In another exemplary embodiment, the locking mechanism comprises teeth on the outer surface adapted to engage teeth located on the inner surface of the locking mechanism carrier, the locking mechanism further comprising teeth on the inner surface adapted to selectively engage teeth located on the outer surface of the mandrel, wherein the teeth on the inner surface of the locking mechanism are adapted to selectively engage the teeth on the exterior of the mandrel in the first direction and to allow the locking mechanism to move along the mandrel in the second direction.

In this embodiment, a vertical face of the exterior teeth of the locking mechanism is inclined between about 80 to 95 degrees from a horizontal plane of the exterior teeth of the locking mechanism; a first angled face of the interior teeth of the locking mechanism is inclined less than or equal to about 70 degrees from a horizontal plane of the interior teeth of the locking mechanism; an angled face of the exterior teeth of the locking mechanism is inclined from the horizontal plane of the exterior teeth of the locking mechanism at an angle about 20 degrees less than the angle at which the first angled face of the interior teeth of the locking mechanism is inclined from the horizontal plane of the interior teeth of the locking mechanism; a second angled face of the interior teeth of the locking mechanism is inclined less than or equal to about 70 degrees from the horizontal plane of the interior teeth of the locking mechanism; and the second angled face of the interior teeth of the locking mechanism is inclined from the horizontal plane of the interior teeth of the locking mechanism at an angle about 20 degrees, or more, less than the angle at which the vertical face of the exterior teeth of the locking mechanism is inclined from the horizontal plane of the exterior teeth of the locking mechanism.

In another exemplary embodiment, the step ratchet assembly comprises: a mandrel having an outer surface; a top connector surrounding the mandrel; a locking mechanism having an inner and outer surface, the inner surface of the locking mechanism adapted to selectively engage the mandrel; and a locking mechanism carrier having an inner and outer surface, the inner surface of the locking mechanism carrier adapted to selectively engage the locking mechanism, wherein the step ratchet assembly is adapted such that the mandrel and the locking mechanism can move relative to each other. The locking mechanism and the locking mechanism carrier are located at an upper end of the top connector adjacent the mandrel, the step ratchet assembly further comprising a second locking mechanism and a second locking mechanism carrier located at a lower end of the top connector adjacent the mandrel.

In yet another embodiment, the driving mechanism comprises: an upper adapter connected to a upper end of the top connector, the upper adapter having a first port adapted to provide fluid pressure to the driving mechanism; a lower adapter connected to a lower end of the top connector, the lower adapter having a second port adapted to provide fluid pressure to the driving mechanism; and a piston located between the upper and lower adapters, the piston adapted to be driven up or down in response to fluid pressure applied from the first or second ports. The step ratchet assembly may further comprise an indicator port adapted to provide an indication of a position of the adjustable orifices.

An exemplary method of the present invention provides a method for movement along a mandrel, the method comprising the steps of providing a downhole assembly surrounding the mandrel, the downhole assembly having a step ratchet assembly attached thereto, the step ratchet assembly comprising: a locking mechanism having an inner and outer surface, the inner surface of the locking mechanism adapted to selectively engage the mandrel; and a locking mechanism carrier having an inner and outer surface, the inner surface of the locking mechanism carrier adapted to selectively engage the locking mechanism; driving the mandrel in a first direction; and driving the mandrel in a second direction opposite the first direction. In another exemplary embodiment, the driving steps are accomplished by applying fluid pressure to a driving mechanism.

Another exemplary embodiment further comprises the step of permitting incremental adjustment of a fluid flow through one or more orifices operatively connected to the mandrel, the incremental adjustment being in response to the driving. In yet another embodiment, the step of driving in the first direction comprises the steps of utilizing teeth on the inner surface of the locking mechanism carrier to engage teeth located on the outer surface of the locking mechanism; and engaging teeth on the mandrel using teeth on the inner surface of the locking mechanism; driving the locking mechanism in the first direction, thereby also driving the mandrel in the first direction to a first position; removing support form the locking mechanism carrier such that the locking mechanism is allowed to ratchet along the mandrel; and driving the locking mechanism in the second direction while the mandrel remains in the first position.

Another exemplary embodiment provides a method for movement along a mandrel, the method comprising the steps of providing a downhole assembly surrounding the mandrel, the downhole assembly having a step ratchet assembly attached thereto, the step ratchet assembly comprising: a locking mechanism having an inner and outer surface, the inner surface of the locking mechanism adapted to selectively engage the mandrel; and a locking mechanism carrier having an inner and outer surface, the inner surface of the locking mechanism carrier adapted to selectively engage the locking mechanism; and moving the downhole assembly and the mandrel relative to each other using the step ratchet assembly.

In another embodiment, the step of moving the downhole assembly and mandrel comprises the steps of: moving the locking mechanism in a first direction, the locking mechanism forcing the mandrel to move in the first direction also, thereby moving the mandrel from an initial position; and moving the locking mechanism relative to the mandrel in a second direction, the second direction being opposite the first direction. In another exemplary embodiment, the moving step further comprises the step of moving the mandrel back to the initial position, the mandrel moving relative to the locking mechanism. A further exemplary method further comprises the step of permitting incremental adjustment of a fluid flow through one or more orifices operatively connected to the mandrel, the incremental adjustment being in response to the movement of the downhole assembly and mandrel.

Although various embodiments have been shown and described, the invention is not limited to such embodiments and will be understood to include all modifications and variations as would be apparent to one skilled in the art.

What is claimed is:

1. A method for movement along a mandrel, the method comprising the steps of:

(a) providing a downhole assembly surrounding the mandrel, the downhole assembly having a step ratchet assembly attached thereto, the step ratchet assembly comprising:

a locking mechanism having an inner and outer surface, the inner surface of the locking mechanism adapted to selectively engage the mandrel; and a locking mechanism carrier having an inner and outer surface, the inner surface of the locking mechanism carrier adapted to selectively engage the locking mechanism and drive the locking mechanism in a first direction or a second direction opposite the first direction;

(b) ratcheting along the mandrel in the second direction; and (c) ratcheting along the mandrel in the first direction.

2. A method as defined in claim 1, wherein steps (b) and (c) are accomplished by applying fluid pressure to a driving mechanism.

3. A method as defined in claim 1, the method further comprising the step of permitting incremental adjustment of a fluid flow through one or more orifices operatively connected to the mandrel.

4. A method as defined in claim 1, wherein step (b) comprises the steps of:

utilizing teeth on the inner surface of the locking mechanism carrier to engage teeth located on the outer surface of the locking mechanism;

engaging teeth on the mandrel using teeth on the inner surface of the locking mechanism;

driving the locking mechanism in the first direction, thereby also driving the mandrel in the first direction to a first position;

removing support from the locking mechanism carrier such that the locking mechanism is allowed to ratchet along the mandrel; and causing the locking mechanism to ratchet along the mandrel in the second direction while the mandrel remains in the first position.

5. A method for movement along a mandrel, the method comprising the steps of:

(a) providing a downhole assembly surrounding the mandrel, the downhole assembly having a step ratchet assembly attached thereto, the step ratchet assembly comprising:

a locking mechanism having an inner and outer surface, the inner surface of the locking mechanism adapted to selectively engage the mandrel; and a locking mechanism carrier having an inner and outer surface, the inner surface of the locking mechanism carrier adapted to selectively engage the locking mechanism and drive the locking mechanism in two directions; and (b) ratcheting the downhole assembly and the mandrel relative to each other in the two directions using the step ratchet assembly.

6. A method as defined in claim 5, wherein the relative ratcheting in the two directions of step (b) comprises the steps of:

moving the locking mechanism in a first direction, the locking mechanism forcing the mandrel to move in the first direction also, thereby moving the mandrel from an initial position; and moving the locking mechanism relative to the mandrel in a second direction, the second direction being opposite the first direction.

7. A method as defined in claim 6, wherein step (b) further comprises the step of moving the mandrel back to the initial position, the mandrel moving relative to the locking mechanism.

8. A method as defined in claim 5, the method further comprising the step of permitting incremental adjustment of a fluid flow through one or more orifices operatively connected to the mandrel.

9. A method for movement along a mandrel, the method comprising the steps of:

(a) providing a downhole assembly surrounding the mandrel, the downhole assembly having a step ratchet assembly attached thereto, the step ratchet assembly comprising:

a locking mechanism having an inner and outer surface, the inner surface of the locking mechanism adapted to selectively engage the mandrel; and a locking mechanism carrier having an inner and outer surface, the inner surface of the locking mechanism carrier adapted to selectively engage the locking mechanism;

(b) driving the mandrel in a first direction, the driving comprising the steps of:

utilizing teeth on the inner surface of the locking mechanism carrier to engage teeth located on the outer surface of the locking mechanism; and engaging teeth on the mandrel using teeth on the inner surface of the locking mechanism;

driving the locking mechanism in the first direction, thereby also driving the mandrel in the first direction to a first position;

removing support from the locking mechanism carrier such that the locking mechanism is allowed to ratchet along the mandrel; and driving the locking mechanism in a second direction opposite the first direction while the mandrel remains in the first position; and (c) driving the mandrel in the second direction.

10. A method as defined in claim 4, wherein step (c) further comprises the step of moving the mandrel in the second direction while the locking mechanism remains stationary, thereby causing the locking mechanism to ratchet along the mandrel in the first direction.

11. A method as defined in claim 9, wherein step (c) further comprises the step of causing the locking mechanism to remain stationary while the mandrel is driven in the second direction.

12. A method as defined in claim 1, wherein step (b) is accomplished via the use of a spring mechanism and step (c) is accomplished via the use of fluid pressure.

* * * * *